US006048272A

United States Patent [19]

Tsujita

[11] Patent Number: 6,048,272

[45] Date of Patent: Apr. 11, 2000

[54] AUTOMATIC BOWLING SCORING APPARATUS AND BOWLING ALLEY MANAGEMENT SYSTEM

[75] Inventor: Masahiro Tsujita, Osaka, Japan

[73] Assignee: Telesystems Co., Ltd., Osaka, Japan

[21] Appl. No.: 08/822,187

[22] Filed: Mar. 20, 1997

[51] Int. Cl.[7] ..... A63D 5/04

[52] U.S. Cl. ..... 473/70; 463/25

[58] Field of Search ..... 473/67, 68, 69, 473/70, 71, 54, 118; 273/349, 350, 351, 352, 138.2, 139, 118 R, 121 B, 459, 460; 463/25, 29, 36; 705/5; 345/173

[56] References Cited

U.S. PATENT DOCUMENTS

| | | | |
|---|---|---|---|
| 5,198,976 | 3/1993 | Form et al. | 473/71 |
| 5,265,874 | 11/1993 | Dickinson et al. | 463/29 |
| 5,397,125 | 3/1995 | Adams | 273/139 |
| 5,502,806 | 3/1996 | Mahoney et al. | 395/161 |
| 5,577,971 | 11/1996 | File | 473/54 |
| 5,588,649 | 12/1996 | Blumberg et al. | 463/25 |
| 5,709,607 | 1/1998 | Mowers et al. | 473/70 |
| 5,732,398 | 3/1998 | Tagawa | 705/5 |
| 5,769,424 | 6/1998 | Kelly et al. | 273/352 |
| 5,836,819 | 11/1998 | Ugawa | 273/121 B |
| 5,850,214 | 12/1998 | McNally et al. | 345/173 |

*Primary Examiner*—Valencia Martin-Wallace
*Assistant Examiner*—John Paradiso
*Attorney, Agent, or Firm*—Pillsbury Madison & Sutro LLP

[57] ABSTRACT

In an automatic bowling scoring apparatus provided with a score counter for determining a score of a bowling game by detecting a passage of a ball and a pin state in a lane, medals for amusement equipment which is other than bowling game equipment and which is played with the medals are discharged onto a medal tray provided on the console that is provided in the bowling game equipment when the counting value of the score counter has come to a predetermined value. This allows the automatic bowling scoring apparatus to be constituted more exciting in addition to the enjoyment derived from the competition for the score of bowling games. Also, exploiting bowlers' play in the game center for bowling games allows the automatic bowling scoring apparatus to be constituted to exhibit improved bowler-pulling power of the bowling alley.

11 Claims, 26 Drawing Sheets

AUTOMATIC BOWLING SCORING APPARATUS AND BOWLING ALLEY MANAGEMENT SYSTEM

BACKGROUND OF THE INVENTION

The present invention relates to an automatic bowling scoring apparatus for automatically executing the score processing of bowling games, and a bowling alley management system for automatically executing the management in a bowling alley.

In conventionally common bowling alleys, there is provided an automatic bowling scoring apparatus which comprises means for detecting the number of pins that have fell down by a bowl, a CRT and the like for automatically executing score calculation in response to the number of fell-down pins and displaying the result. The provision of this automatic bowling scoring apparatus allows bowlers to devote themselves to the games, while it contributes to smooth progress of bowling games so that the rate of turnover is improved.

Also in conventional bowling alleys, bowlers ask for a reception at the front desk, where if there is an empty lane left at the time of the reception, the bowlers are allowed to start games at the empty lane, and if not, the name of the representative or the like for the bowlers is entered into a waiting list for the time being. Then, the group of bowlers wait until their turn comes up according to the waiting order. Generally, bowling alleys are in many cases provided with a game center of amusement equipment other than the bowling game equipment, so that the members of waiting groups often spend time playing amusement games in the game center.

Also in conventional bowling alleys, it has been a common practice of enjoying a bowling alley that after bowlers have asked for a reception at the front desk, they play games in a designated empty lane and, over the bowling games, pay the charge responsive to the number of games and the like, thus leaving the bowling alley.

With the conventional automatic bowling scoring apparatus, indeed the bowling games will progress smoothly as a whole so that the rate of turnover of the bowling alley can be expected to improve, but the way of enjoying the bowling game or its enjoyment itself for bowlers is not so much changed, such that the bowling game has been no more than a game the sporting attribute of which is to be enjoyed primarily. However, even for such a game of high sporting attribute, there has been a demand for adding new attractions to the existing sporting attribute in order to obtain, for example, such pulling power that those weak in the bowling can also be bowlers.

Also in conventional bowling alleys, when bowlers exploit, during the order-waiting period, the game center provided additionally to the bowling alley or provided on another floor separetely from the floor on which the bowling game equipment is provided, the bowlers may merely kill time in the game center, in which case the game center would not contribute to the pulling-power effect of the bowling alley. For example, the bowlers could not put into effective use the medals acquired by so-called medal game machines installed in the game center.

Also in conventional bowling alleys, there have been needs of a reception process at the front desk and a reckoning process at the front desk after the end of games, unlike coin amusement equipment, such that some people would feel burdensome in taking these steps. As a result, there has been a desire for a system that contributes to such an enhancement in the pulling power that those people also will be bowlers.

An object of the present invention is therefore to provide an automatic bowling scoring apparatus which can make the bowling game itself more exciting in addition to the pleasure attributable to the competition for the score of bowling games.

Another object of the invention is to provide an automatic bowling scoring apparatus, as well as a bowling alley management system, In which play by bowlers in the game center is effectively incorporated into their bowling games, so that the pulling power of a bowling alley is improved.

Yet another object of the invention is to provide a bowling alley management system which has eliminated the burdensome procedure so as to allow bowlers to feel free playing the bowling game.

SUMMARY OF THE INVENTION

In an embodiment of the present invention, there are provided a score counter for determining a score of a bowling game by detecting a passage of a ball and a pin state in a lane, and a medium operator for, when the score state has come to a predetermined state, discharging a medium, such as medals, used in amusement equipment other than bowling game equipment or writing specified information into a medium, such as a magnetic card, with the aim of making the bowling game more exciting by arousing bowlers' passion for gambling and appealing to actual profits for the bowlers. In another embodiment, there is provided a a medium operator for increasing or decreasing points other than the score of the bowling game each time the score value comes to a predetermined value, and for discharging a medium, such as medals, corresponding to the points and used in amusement equipment other than bowling game equipment or writing information corresponding to the points into a medium, such as a magnetic card, when the bowling game is ended. Further in another embodiment, there is provided an adder for adding the increased or decreased state of the points to the display contents of the score.

Also, in another embodiment of the invention, for the purposes of displaying another amusement play onto the displaying device, which displays the score of the bowling game, for increased enjoyment, and of arousing bowlers' passion for gambling and appealing to actual profits for more exciting bowling games, there is provided a medium operator for discharging a medium, such as medals, used in amusement equipment other than bowling game equipment or writing information into a medium, such as a magnetic card, when a playing result of the amusement play displayed by the amusement-play displaying device has come to a predetermined state. Also in another embodiment of the invention, there is provided a medium operator for discharging a medium, such as medals, used in amusement equipment other than bowling game equipment in response to a playing result of an amusement play displayed by an amusement-play displaying device or writing information into a medium such as a magnetic card when the bowling game is ended. Further in another embodiment of the invention, there is provided an adder for increasing or decreasing points other than the score of the bowling game in response to a playing result of an amusement play displayed by an amusement-play displaying device and for adding the increased or decreased state to display contents of the score.

In another embodiment of the invention, with the aim of arousing bowlers' passion for gambling and appealing to actual profits for more exciting bowling games, a bowling alley management system including the automatic bowling scoring apparatus comprises:

a premium selecting device for, upon receiving the medium, displaying a selection screen of a plurality of premiums corresponding to value of the medium, and for printing and outputting an exchange sheet for a selected premium upon occurrence of an input operation for selecting from among the premiums.

Also in another embodiment of the invention, a bowling alley management system including the automatic bowling scoring apparatus comprises: a front manager provided at a front desk; and with the aim of arousing bowlers' passion for gambling and appealing to actual profits for more exciting bowling games, a premium selecting device for, upon receiving the medium, displaying a selection screen of a plurality of premiums corresponding to value of the medium, and for transferring identification information on a selected premium upon occurrence of an input operation for selecting from among the premiums. The front manager receives and displays the identification information on the premium.

Also in another embodiment of the invention, there are provided a counter for determining a score of a bowling game by detecting a passage of a ball and a pin state in each lane, and a reckoning device for reckoning a charge for bowling games in response to a game count, wherein, in order that bowlers' play at the amusement equipment other than bowling game equipment, such as medal game machines, during the waiting period of the bowlers will not be in vain or that the medium obtained by the bowlers at the bowling scoring apparatus will be effectively utilized, the reckoning device accepts the medium used in the amusement equipment other than bowling game equipment, and reckons a bowling-game charge corresponding to value of the accepted medium.

Also in still another embodiment of the invention, there are provided:

a reception device for executing assignment of a lane from among empty lanes or management of waiting order upon an operation by an incoming bowler or by a clerk in charge at a reception; and a console which is provided for each lane or for every some plurality of lanes and which includes a device for determining a score of a bowling game by detecting a passage of a ball and a pin state in a lane, wherein, with an aim of simplifying the reception process at a start of a bowling game and the reckoning process after an end of the bowling game, the reception device includes an accepting device for accepting a medium used in amusement equipment other than bowling game equipment, instead of a game charge, and a controller which starts the lane assignment or waiting-order management when the accepting device has accepted the medium.

Also in another embodiment of the invention, there are provided: a score counter for determining a score of a bowling game by detecting a passage of a ball and a pin state in a lane;

with an aim of simplifying the reception process at a start of a bowling game and the reckoning process after an end of the bowling game, an accepting device for accepting a medium used in amusement equipment other than bowling game equipment; and a controller for executing score counting by the score counter with respect only to number of games or number of frames corresponding to value of the medium accepted by the accepting device.

With an automatic bowling scoring apparatus according to an embodiment of the present invention, for example, the discharge of medals that can be used in medal game machines or the like by the medium operator, the writing of specified point information into a magnetic card that can retain point data (the magnetic card is usable in game machines other than bowling game equipment), and other processes are executed when the score value of a bowling game determined by detecting a passage of a ball and the resulting pin state at the lane has come to a predetermined value, such as upon a strike or a spare or a coincidence of the score pattern with a predetermined pattern. Also, with an automatic bowling scoring apparatus according to another embodiment of the invention, points other than the score of the bowling game are increased or decreased each time the score state of the bowling game determined by detecting a passage of a ball and the resulting pin state at the lane has come to a predetermined state, such as upon a strike or a spare or a coincidence of the score pattern with a predetermined pattern. Then, responsive to the points at an end of the game, for example, medals that can be used in medal game machines are discharged or specified point information is written into a magnetic card that can retain point data (the magnetic card is usable in game machines other than bowling game equipment) or other processes are executed.

With the use of a medium obtained in this way, the bowlers are allowed to play an amusement game or the like with any of amusement equipment in the game center laid out on a floor same as or different from the floor on which the bowling game equipment is provided. This can arouse bowlers' passion for gambling and appeal to actual profits for the bowlers, so as to enhance the excitement of the bowling game. Further, with an automatic bowling scoring apparatus according to an embodiment of the invention, since the increased or decreased state of points is added to the contents of score display, the bowlers are allowed to easily confirm the increased or decreased state of points as well as the contents of the score itself. This can enhance the excitement of the bowling game.

With an automatic bowling scoring apparatus according to yet another embodiment of the invention, another amusement play such as slot machine, roulette, and sugoroku (a Japanese variety of Parcheesi) is displayed on a displaying device in response to the score state or the pin state. When the playing contents of the amusement play have come to a predetermined state, for example, medals to be used in medal game machines are discharged or specified point information is written into a magnetic card that can retain point data (the magnetic card is usable in game machines other than bowling game equipment) or other processes are executed.

Further, with an automatic bowling scoring apparatus according to still another embodiment of the invention, when the bowling games have been completed, for example, medals to be used in medal game machines are discharged or specified point information is written into a magnetic card that can retain point data (the magnetic card is usable in game machines other than bowling game equipment) or other processes are executed, in response to the playing contents of the another amusement play. With the use of a medium obtained in this way, the bowlers are allowed to play an amusement game with any of amusement equipment in the game center laid out on a floor same as or different from the floor on which the bowling game equipment is provided. This can arouse bowlers' passion for gambling and appeal to actual profits for the bowlers, so as to enhance the excitement of the bowling game. Further, with an automatic bowling scoring apparatus according to another embodiment of the invention, since points other than the score of the bowling game are increased or decreased in response to the playing contents of the another amusement play and the resulting increased or decreased state of points is added to the contents of score display, the bowlers are allowed to easily confirm the playing contents of the another amusement play as well as the contents of the score itself. This can enhance the excitement of the bowling game.

With a bowling alley management system according to a still further embodiment of the present invention, when a medium obtained from the automatic bowling scoring apparatus is thrown into the premium selector, a screen for selecting from among a plurality of premiums is displayed responsive to the value of the medium, in which screen an exchange sheet for the corresponding premium is printed out by an operation of selection from among the premiums. This premium-exchange sheet is then exchanged for an actual premium at the front desk or the like. Also, with a bowling alley management system according to yet another embodiment of the invention, when a medium obtained from the automatic bowling scoring apparatus is thrown into the premium selector, a screen for selecting from among a plurality of premiums is displayed responsive to the value of the medium, in which screen identification information for the corresponding premium is transferred to the front manager by an operation of selecting from among the premiums. As a result, the bowlers are allowed to receive the actual premium. In this way, since the bowlers can play the bowling game with the aim of premiums, the enjoyment of the bowling game is increased. Besides, since the procedure of premium exchange is partly automated, the working burden on the bowling alley side is reduced.

With a bowling alley management system according to another embodiment of the invention, when a medium, such as medals or a magnetic card, obtained from amusement equipment other than bowling game equipment is thrown by the bowlers, the medium serves for the charge of the bowling game or as part of the charge. In this way, since the charge reckoning for bowling games is carried out by using a medium obtained from amusement equipment other than bowling game equipment or a medium obtained by playing the bowling game (both media are of the same kind), it becomes possible to systematically combine amusement equipment other than bowling game equipment and bowling game equipment with each other. This contributes to the improvement in the service for bowlers.

With a bowling alley management system according to a still another embodiment of the invention, the charge for games can be paid with the medium obtained from amusement equipment other than bowling game equipment, and the lane assignment out of empty lanes or the waiting-order management is treated with the medium. Therefore, the bowlers are allowed to use the bowling alley with the medium. Also since the charge reckoning is no longer needed after the end of the bowling games, the bowlers become free to enjoy playing the bowling game.

With an automatic bowling scoring apparatus according to yet another embodiment of the invention, a medium, such as medals or a magnetic card, used in amusement equipment other than bowling game equipment can be accepted, and the score counting is done in correspondence to the game number or frame number responsive to the value of the accepted medium. Therefore, the bowlers are allowed to immediately start playing the bowling game with the medium. Also since the charge reckoning is no longer needed after the end of the bowling games, the bowlers become free to enjoy playing the bowling game.

DETAILED DESCRIPTION OF THE PREFERRED EMBODIMENTS

The arrangement of a bowling alley management system, which is a first embodiment of the present invention, is described below with reference to FIGS. 1 to 12.

Figure 1:
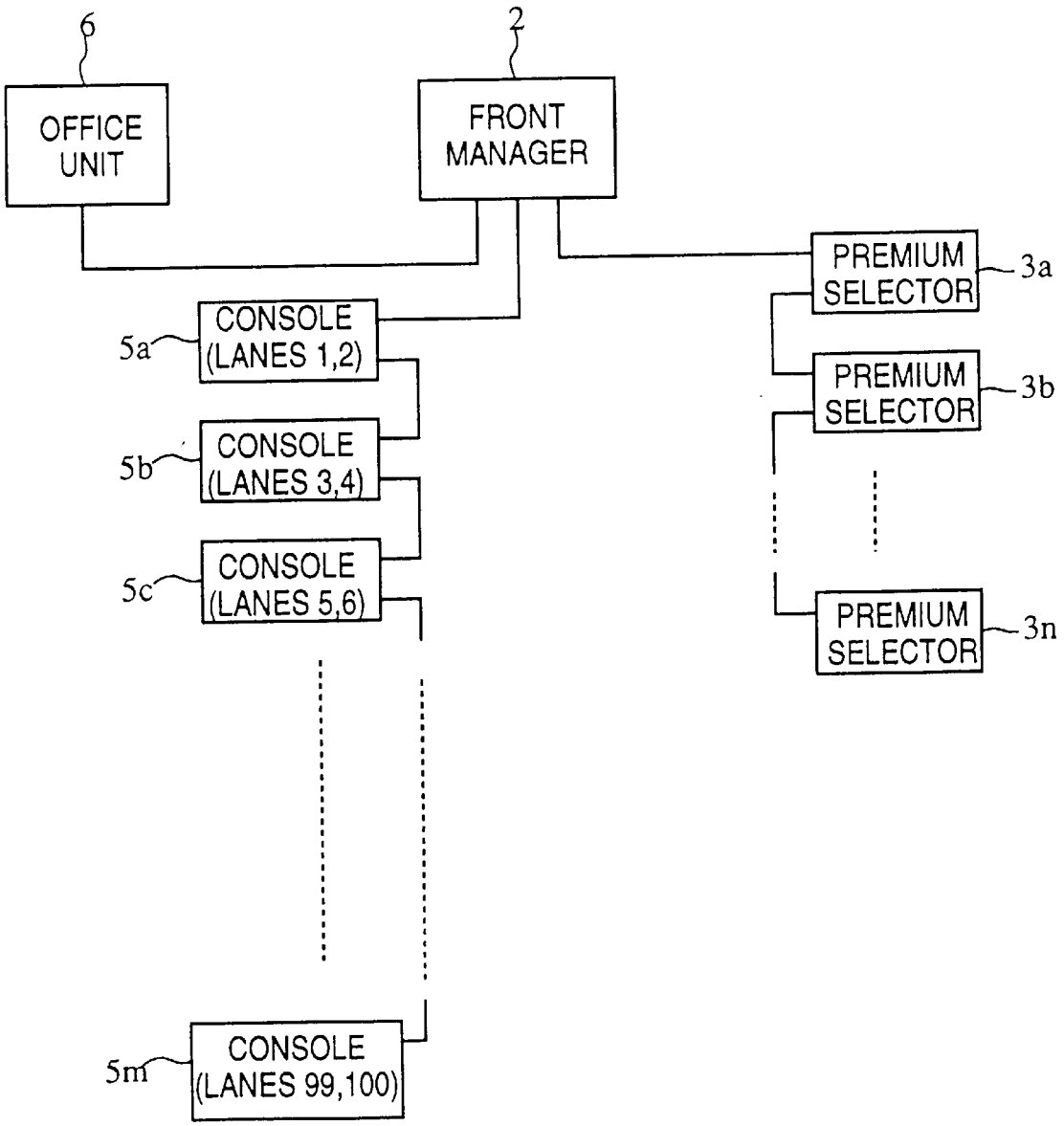
FIG. 1 is a block diagram showing the overall arrangement of a bowling alley management system according to the first embodiment.

FIG. 1 is a block diagram showing the overall arrangement of the bowling alley management system. In this case, a front manager 2 provided at the front desk, consoles 5*a*, 5*b*, 5*c*, . . . , 5*m* provided for every two lanes, premium selectors 3*a*, 3*b*, . . . , 3*n*, and an office unit 6 provided in the office are connected together via a local area network.

Figure 2:
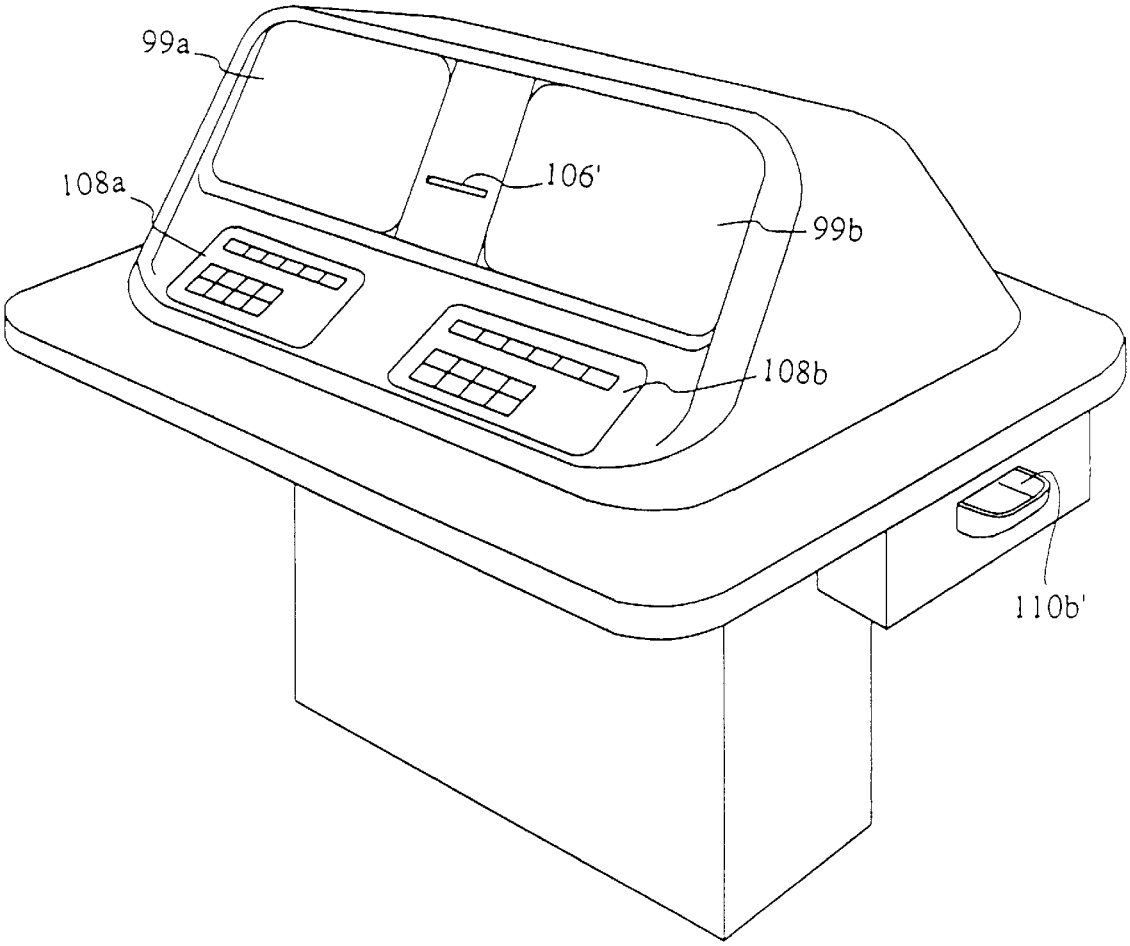
FIG. 2 is an appearance perspective view of the console.

FIG. 2 is an appearance perspective view showing the arrangement of one console corresponding to the automatic bowling scoring apparatus. Referring to FIG. 2, numerals 99*a*, 99*b* each denote a CRT for displaying the score as well as, for example, a message representing that the score has come to a predetermined specific state, and numerals 108*a*, 108*b* each denote a keyboard used for the correction of the names of bowlers, the correction of the score, and the like. Numeral 106' denotes a paper outlet of the printer for outputting score sheets and the like, where the printer is shared by right and left lanes. A device denoted by numeral 110*b*' is a receiver tray for medals derived from a medal hopper that discharges a specified amount of medals under specified conditions. This receiver tray is provide also on the left side in the figure for the left-side lane.

Figure 3:
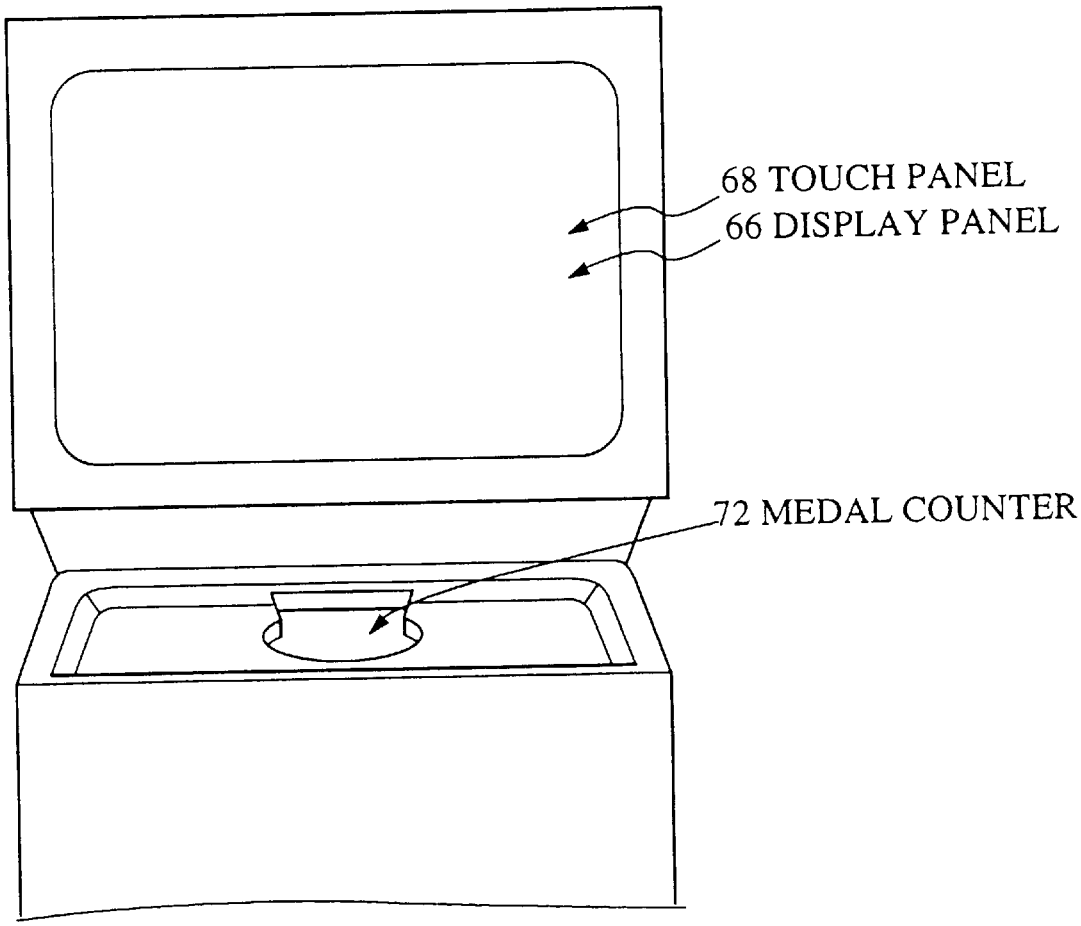
FIG. 3 is an appearance front view of the premium selector.

FIG. 3 is an appearance front view showing the arrangement of the premium selector. Referring to FIG. 3, numeral 66 denotes a display panel for displaying in a list the names of premiums to be selected and the like, and 68 denotes a touch panel for detecting any touch position on the display panel. Numeral 72' denotes a medal throw-in opening of a medal counter that identifies the types of medals that have been thrown in and that performs counting as to regular medals.

Figure 4:
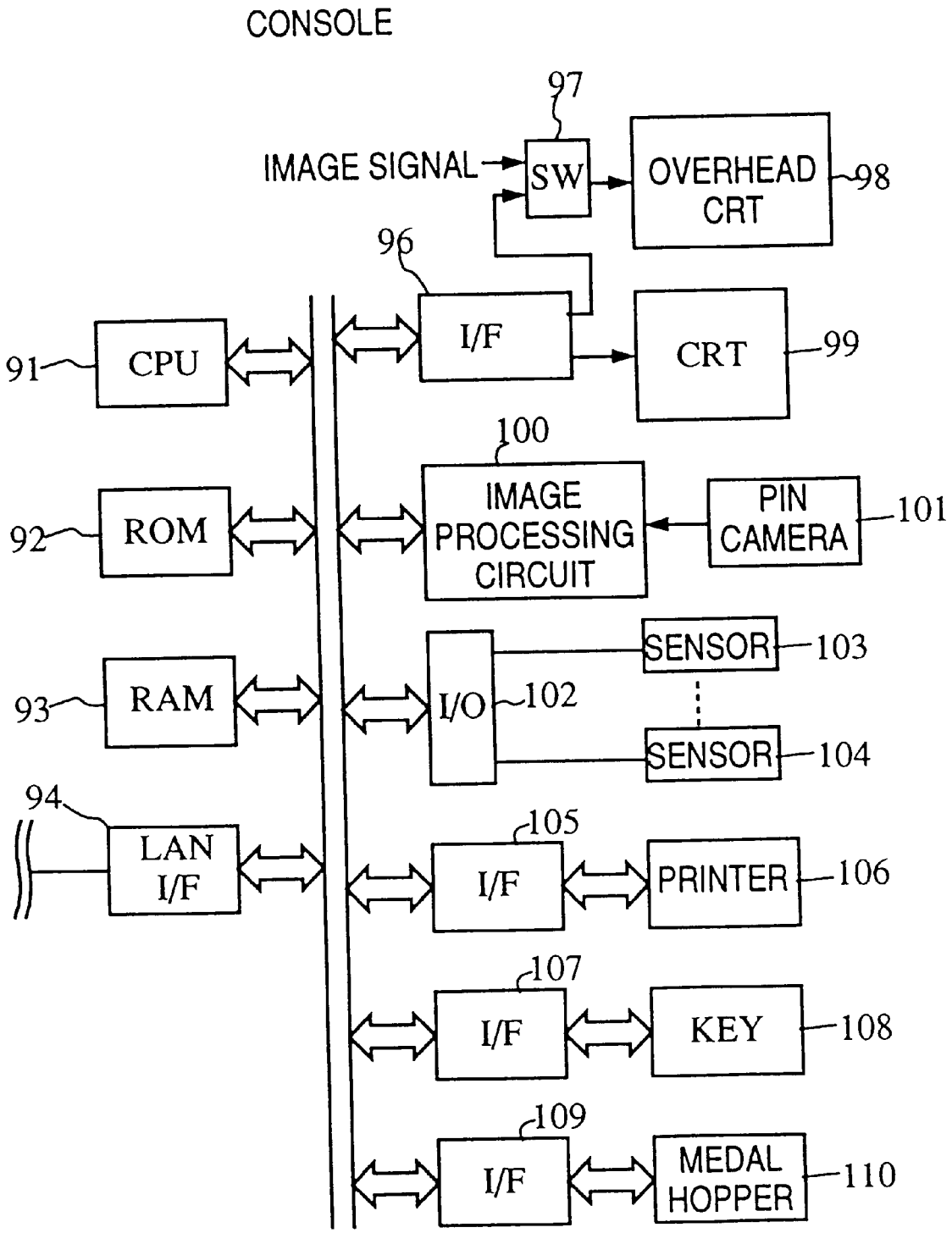
FIG. 4 is a block diagram showing the arrangement of the console.

FIG. 4 is a block diagram showing a part of one console out of the consoles 5*a*, 5*b*, 5*c*, . . . , 5*m* shown in FIG. 1, which executes the score processing for one lane. A CPU 91 executes programs previously written in a ROM 92. A RAM 93 is used as various types of working areas for temporary storage of score information or the like during the execution of the programs. A LAN interface 94 is a circuit for interfacing with a local area network, and executes the transfer control of various data in conjunction with the front manager or the like via the local area network. An overhead CRT 98, which is a large-size CRT provided above the approach, displays the score, pin actions, and other images. A switch circuit 97 executes the selection between the image signal derived from a display interface 96 and the other image signals. The display interface 96, which has display memory, gives a display signal to the overhead CRT 98 via a CRT 99 and the switch 97, in response to the contents of the display memory. The CRT 99, which is a display section provided in the main body of the console as shown in FIG. 2, displays the score as well as, for example, a message representing that the score has come to a specific state. A pin camera 101 picks up the image of positional arrangement of bowling pins, while an image processing circuit 100 executes certain image processing on the image signal to generate digital image data. The CPU 91 reads the resulting digital image data to detect an erect/down state of the bowling pins. Sensors 103, . . . , 104 are ball passage sensors and foul sensors provided at specified positions on the lane, where the CPU 91 reads the state of the various sensors via an I/O port 102. A printer 106 is used to print out the score, where the CPU 91 outputs print data via an interface 105. A keyboard 108 is used for executing the correction of the names of bowlers and the like from the console side or for processing at the end of the games, where the CPU 91 reads the contents of such key operations via an interface 107. A medal hopper 110 is a device for discharging medals to be used for medal amusement equipment when the score has come to a specific state as shown in FIG. 2, where the CPU 91 makes a specified amount of medals discharged via an interface 109. The medal hopper 110 also generates a medal-empty signal when the remaining amount of stored medals has become below a specified amount. The CPU, upon detecting the generation of this signal, transmits a command for notifying the front manager of a need of replenishing medals. The front manager, upon receiving this command, displays an alarm of medal replenishment onto the CRT.

Figure 5:
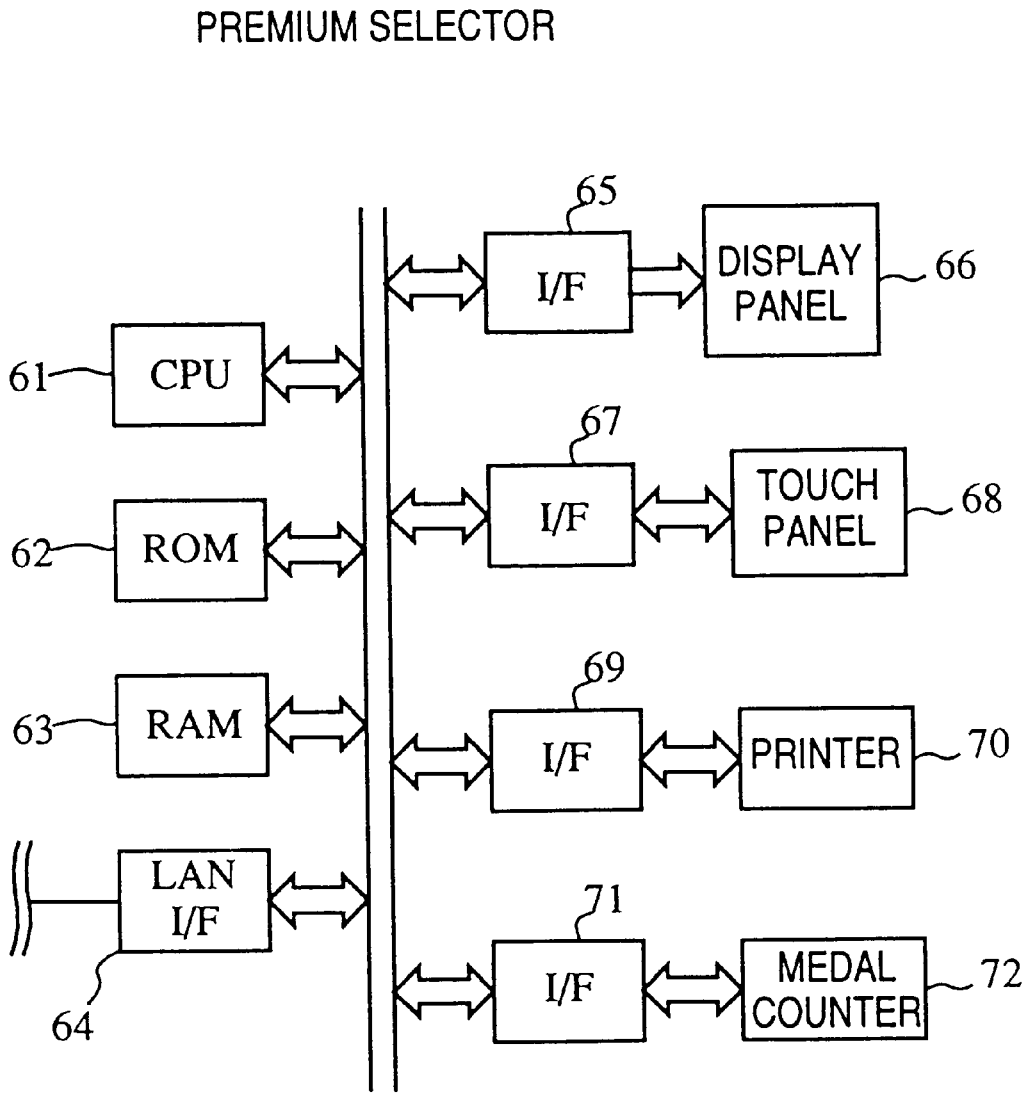
FIG. 5 is a block diagram showing the arrangement of the premium selector.

FIG. 5 is a block diagram showing the arrangement of one of the premium selectors 3*a*, 3*b*, . . . , 3*n* shown in FIG. 1. Referring to FIG. 5, a CPU 61 executes programs previously written in a ROM 62. A RAM 63 is used as various working areas in executing the programs. A LAN interface 64 is an interface circuit in conjunction with a local area network, and executes the transfer control of various data in conjunction with the front manager or the like via the local area network. A display panel 66 displays in a list the names of exchangeable premiums, where the CPU 61 executes the display of them via an interface 65. A touch panel 68, which is provided in the front of the display panel 66, is used for inputting operation of premium selection. The CPU 61 reads a touch position via an interface 67. A printer 70 is used for outputting premium-exchangeable receipts, where the CPU 61 gives print data via an interface 69. A medal counter 72 is a device for identifying the type of thrown-in medals and counting regular medals, where the CPU 61 reads those data via an interface 71.

Figure 6:
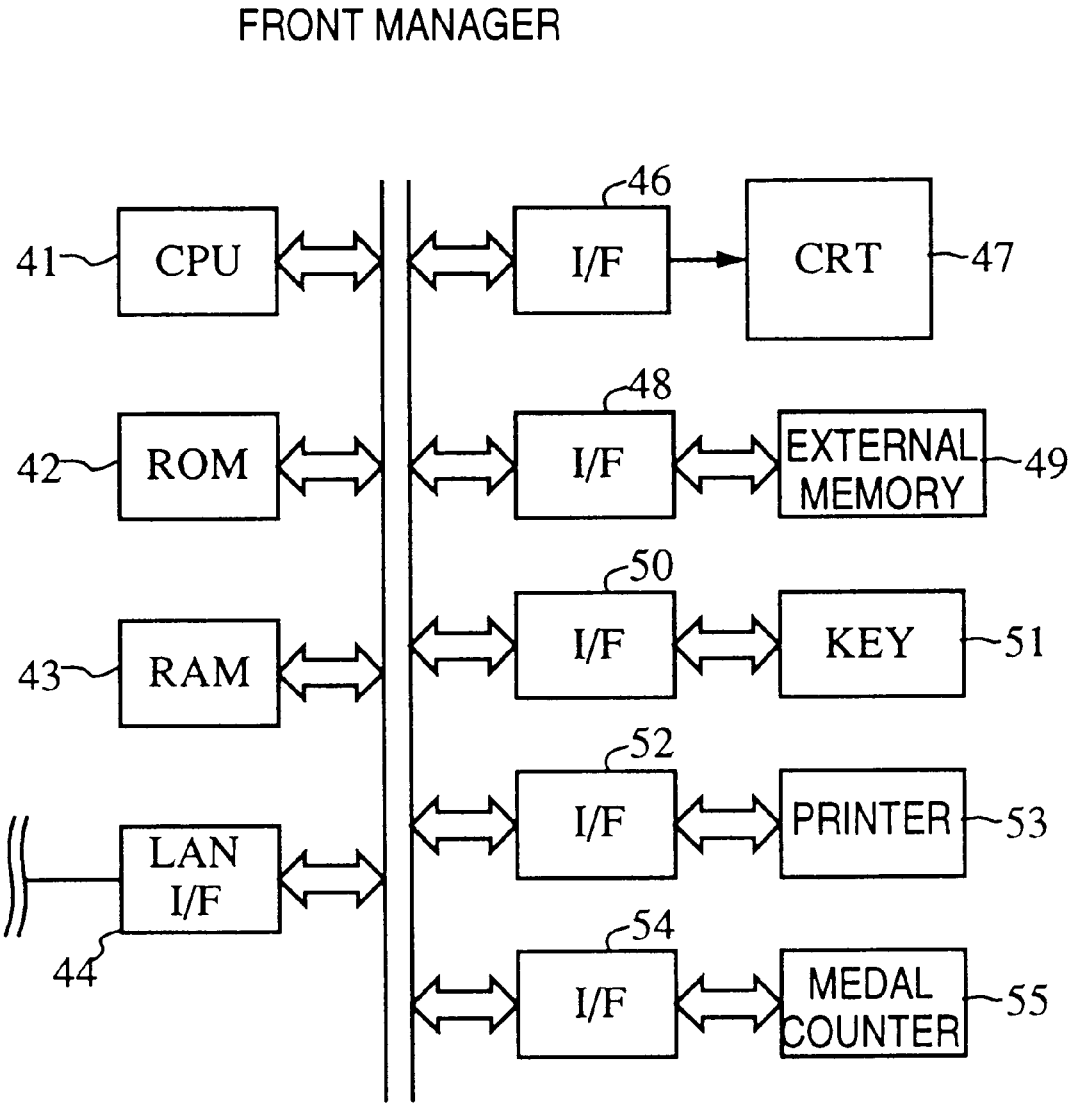
FIG. 6 is a block diagram showing the arrangement of the front manager.

FIG. 6 is a block diagram showing the arrangement of the front manager. A CPU 41 executes a program previously written into a ROM 42 and a program loaded from an external memory 49. A RAM 43 is used as various working areas in executing the programs. A LAN interface 44 is an interface circuit in conjunction with a local area network, and executes the transfer control of various data in conjunction with the console or the like via the local area network. A display interface 46, which has display memory, outputs a display signal for a CRT 47. The external memory 49 is an external storage device such as a hard disk unit, while the CPU 41 performs the read/write of various data via an interface 48. A keyboard 51 is used for the setting input of data that include the input of identification information such as the names of bowlers, input for designating the charge reckoning, and how many medals should be discharged in what state of score (hereinafter, the data will be referred to as premium data), and the like. The CPU 41 reads the contents of key operations via an interface 50. A printer 53 is used to print score sheets or the like. The CPU 41 outputs print data via an interface 52. A medal counter 55 is a device for identifying the types of thrown-in medals at the time of charge reckoning, and for counting regular medals, where the CPU 41 reads these data via the interface 54 and performs a discounting process in the charge reckoning.

Figure 7A:
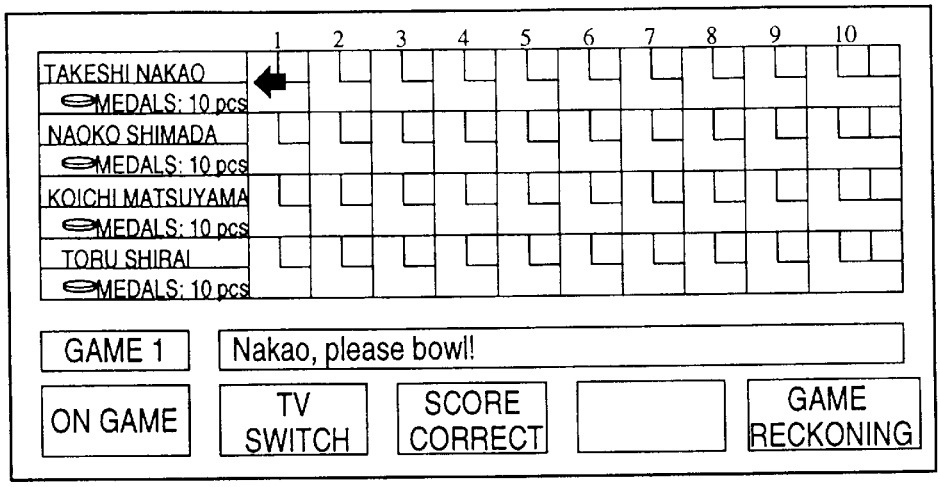
FIGS. 7A, 7B, 7*c* are views showing display examples on the console.
Figure 7B:
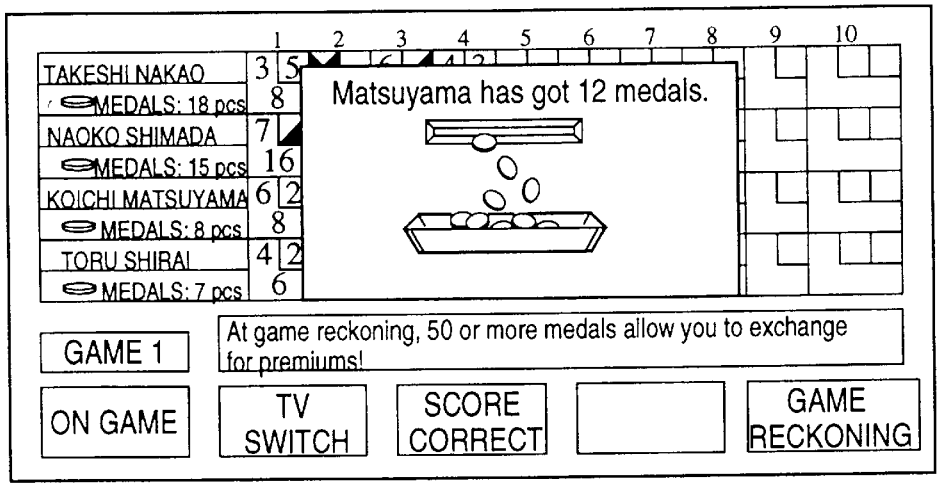
Figure 7C:
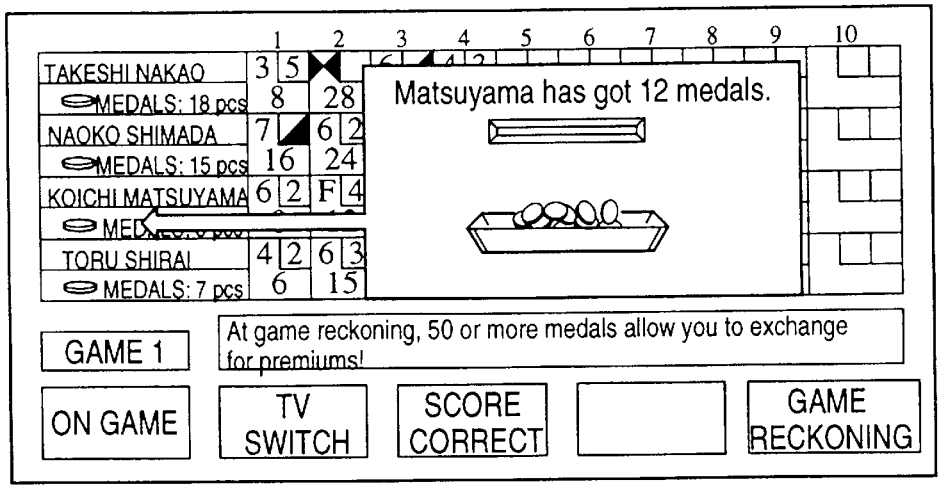
Figure 8:
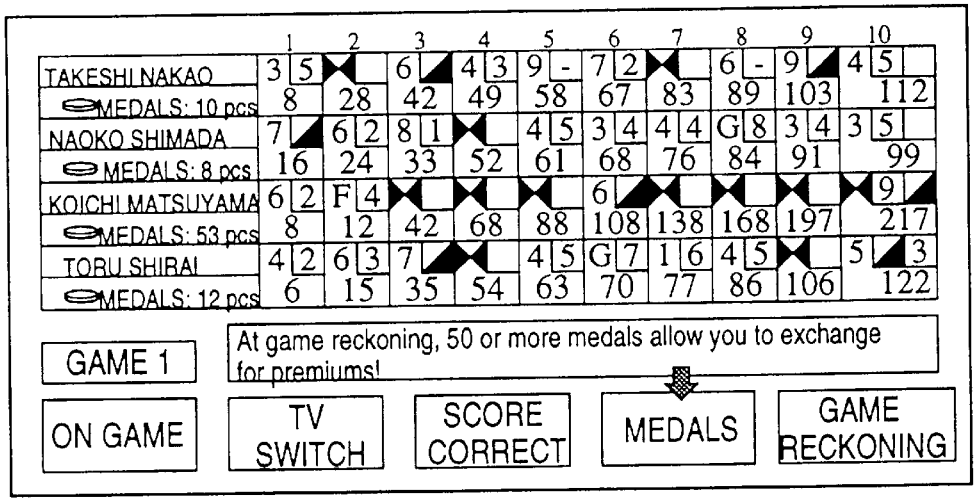
FIG. 8 is a view showing a display example on the console.

FIGS. 7 and 8 are views showing display examples on the console. FIG. 7A is a display example of the initial screen at the start of a bowling game, where the score is displayed for each bowler and the number of medals is displayed for each bowler. In this example, it is shown that ten medals have previously been given to each of four bowlers. This number of medals is decremented by one each time one frame is completed, whereas the occurrence of a strike or spare causes a predetermined number of medals to be added responsively. Accordingly, the number of medals acquired will change in response to the progressing circumstances of the game. In addition, the arrow in the score display shows the bowler designated for the next bowl. FIG. 7B is a display example during the game, and FIG. 5C is a display example subsequent to FIG. 7B. These show that a bowl by the third bowler (Koichi Matsuyama) has resulted in a strike so that discharging four medals is simulatively displayed, with the result that Matsuyama's number of medals at the end of the fourth frame has become 12. FIG. 8 is a display example at a time point when the four bowlers have completed one game. In this state, if a function key corresponding to the display field where "MEDAL" is displayed is operated out of the four function keys in the figure, medals that count the total number acquired by the four bowlers are discharged. In this process, the total number of medals are discharged if the total number is equal to or greater than 50, while no medals are discharged if the total number is smaller than 50. Therefore, with the total number of medals around 40, playing one additional game could allow an expectation of the discharge of medals, which would lead to a game-accelerating effect. Also, a gorgeous sound during the discharge of medals can make bowlers excited. Otherwise, it may be arranged that the medals responsive to the points acquired by each bowler are discharged individually for each bowler.

Figure 9:
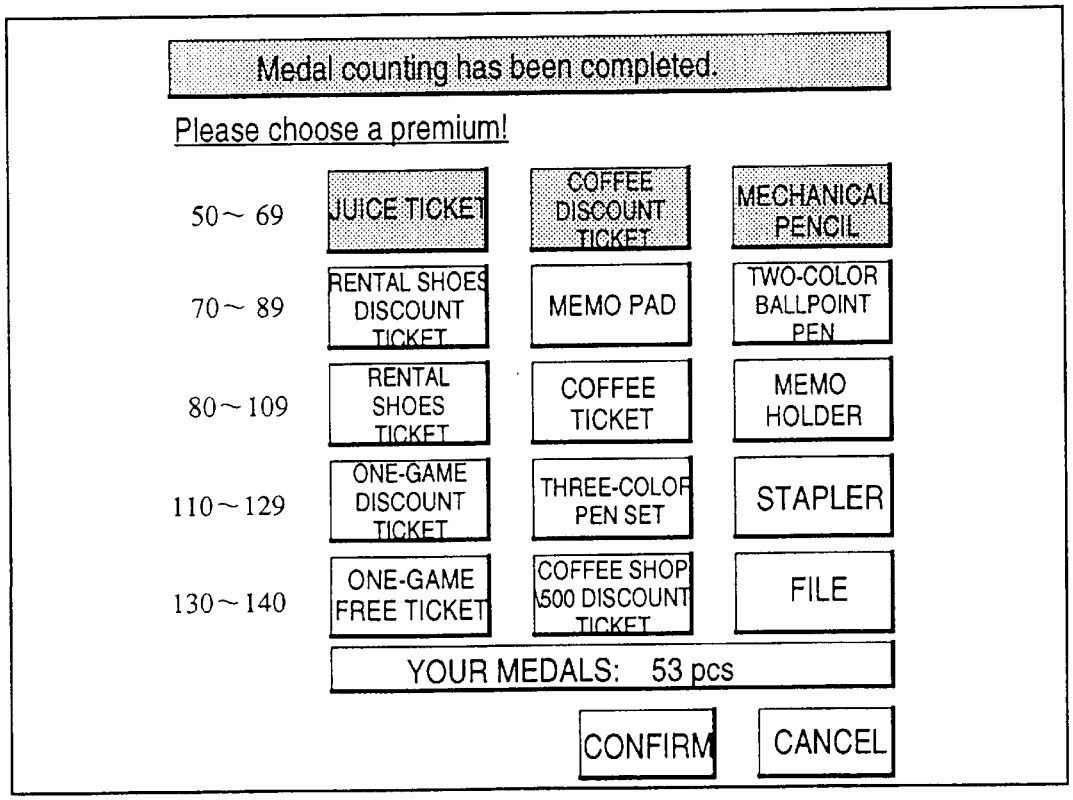
FIG. 9 is a view showing a display example on the premium selector.

FIG. 9 is a view showing a display example of the premium selector. When the medals acquired by the bowlers are thrown into the premium selector, the premium selector displays the names of exchangeable premiums. For example, if 53 medals that Matsuyama has acquired are thrown in, the names of premiums exchangeable with 50 to 69 medals are displayed in a color different from that of the other premiums. In this state, for example, touching a display button of a mechanical pencil causes a exchange receipt for a mechanical pencil to be printed. Given an arrangement that the greater the number of medals increases, the more objectively valueable the set premiums are as shown in FIG. 9, it would be the case that the bowlers consider how many medals should be added to the number of medals acquired by now in order to enable an exchange for a premium or to enable an exchange for an even one-rank higher premium, with the result that the bowlers are more likely to continue playing games with the aim of acquiring additional medals.

Figure 10:
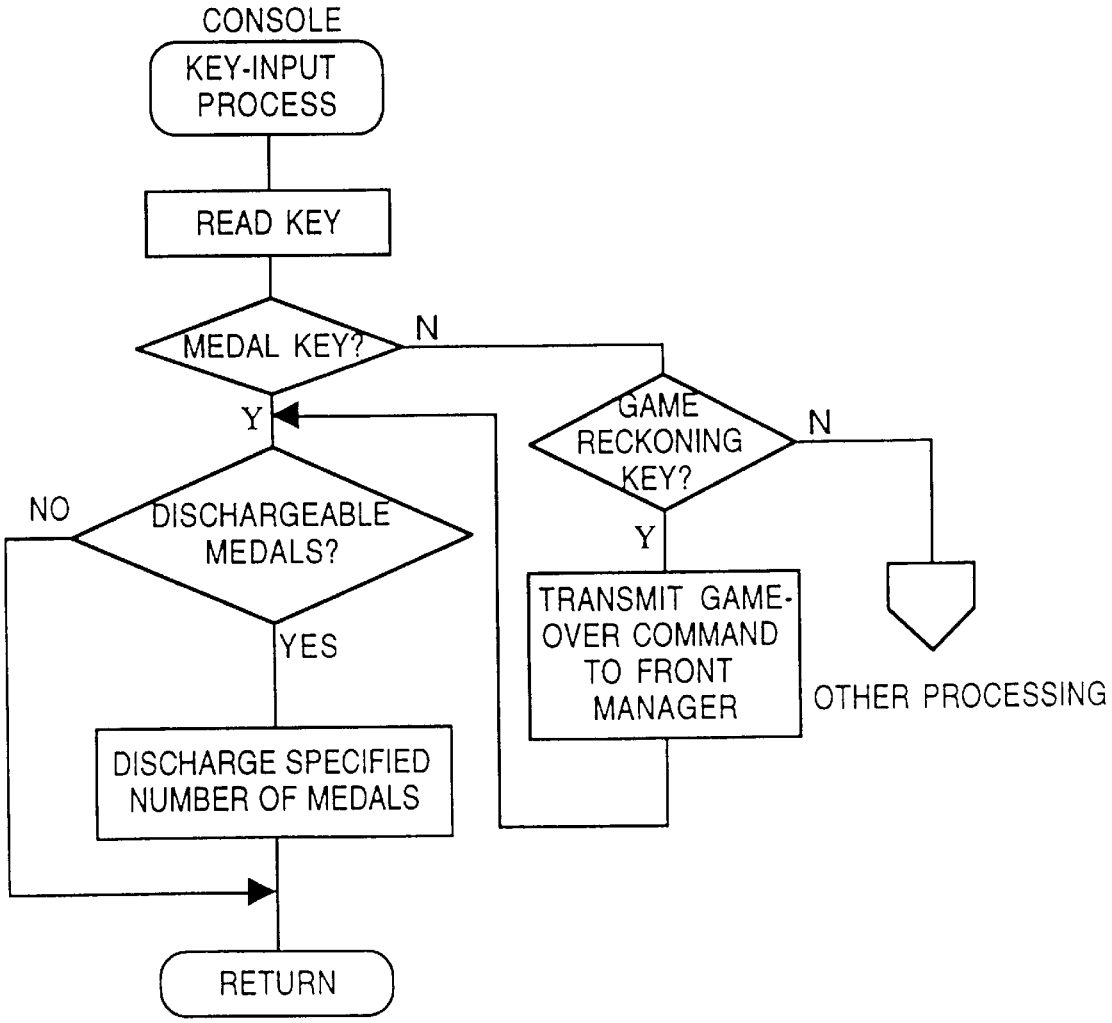
FIG. 10 is a flow chart showing the contents of key-input processing by the console.

FIG. 10 is a flow chart showing the key-input processing by the console, which corresponds to another example of the automatic bowling scoring apparatus. Upon some key operation, the console reads it. For example, if the medal key is operated, the console discharges medals, if any at that time, in a number responsive to the points. Also, if the game reckoning key is operated, the console transmits a game-over command to the front manager.

Figure 11:
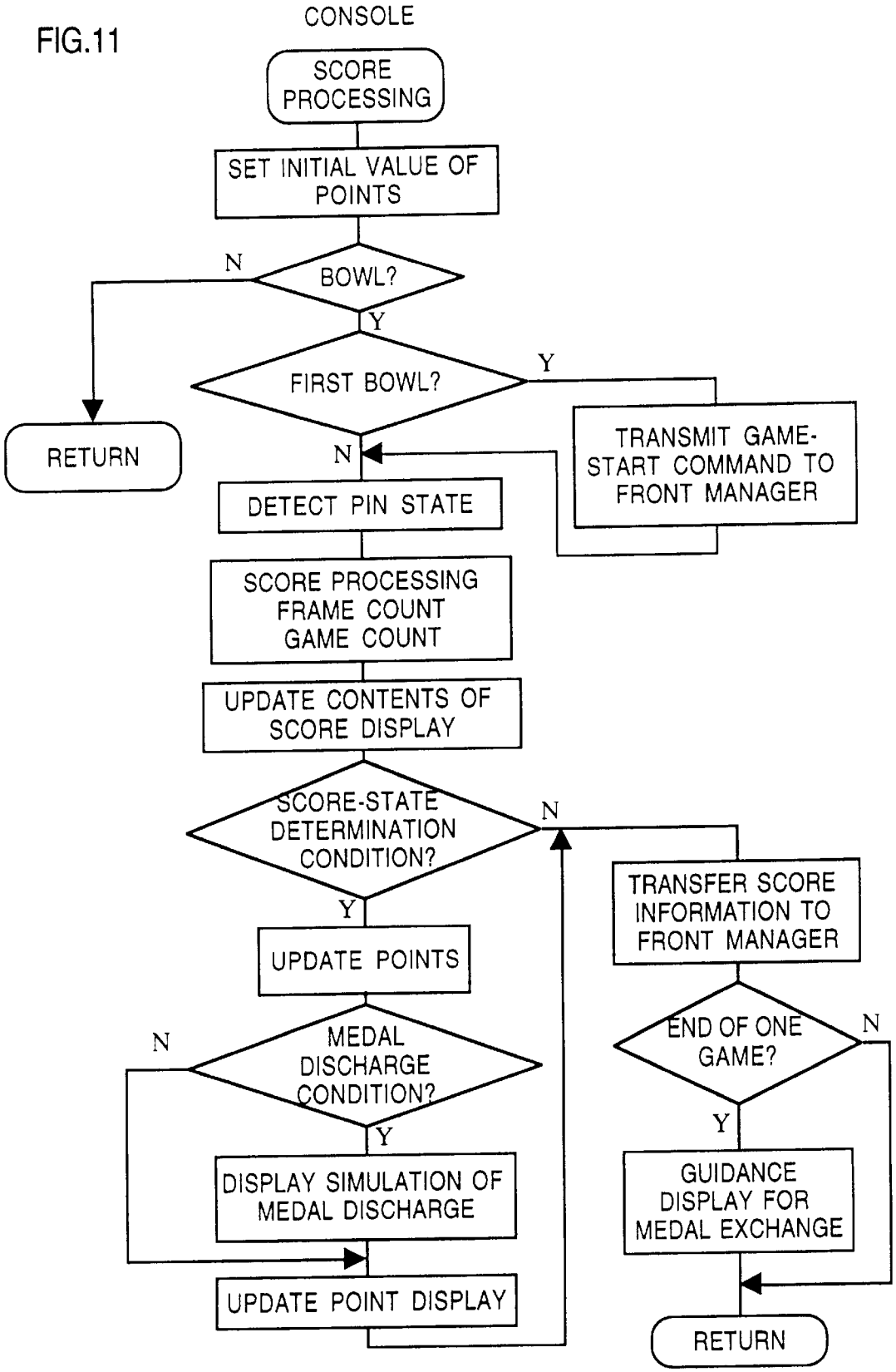
FIG. 11 is a flow chart showing the procedure of score processing by the console.

FIG. 11 is a flow chart showing the procedure of score processing by the console. First, the console sets the points (number of medals) of each bowler to an initial value (10). When the first bowl is effected, the console transfers a game-start command to the front manager. The console detects the pin state after each bowl, and executes the score processing, the counting of frame number or the counting of game number based on the detection result. Subsequently, responsive to the processing result, the console updates the contents of score display. For example, the console decrements the points of the pertinent bowler by 1 at a time point of determining the score state (at a time point when the conditions for determining the score state have been satisfied), such as when one-frame bowls have been completed (i.e., 1 is subtracted each time one frame has been completed). However, when the current score state has come to a predetermined state (e.g., a strike or spare), the console presents a simulative display of discharging a specified number of medals, updating the display of points. Thereafter, the console transfers score information including the points to the front manager. Further, at a time point when one game is completed, the console presents a guidance display for operating the medal key as shown in FIG. 8. In addition, how many points should be added in what state of score is determined based on premium data received and set from the front manager. For example, 5 points for a strike, 2 points for a spare, are added at that time; at an end of the ten frames, 50 points are added if all the frames have been spared, 80 points are added if the total points of the individual frames have been equal among all the frames, and 90 points are added if the one-game score has resulted in any one of 100, 200, or 300.

Figure 12:
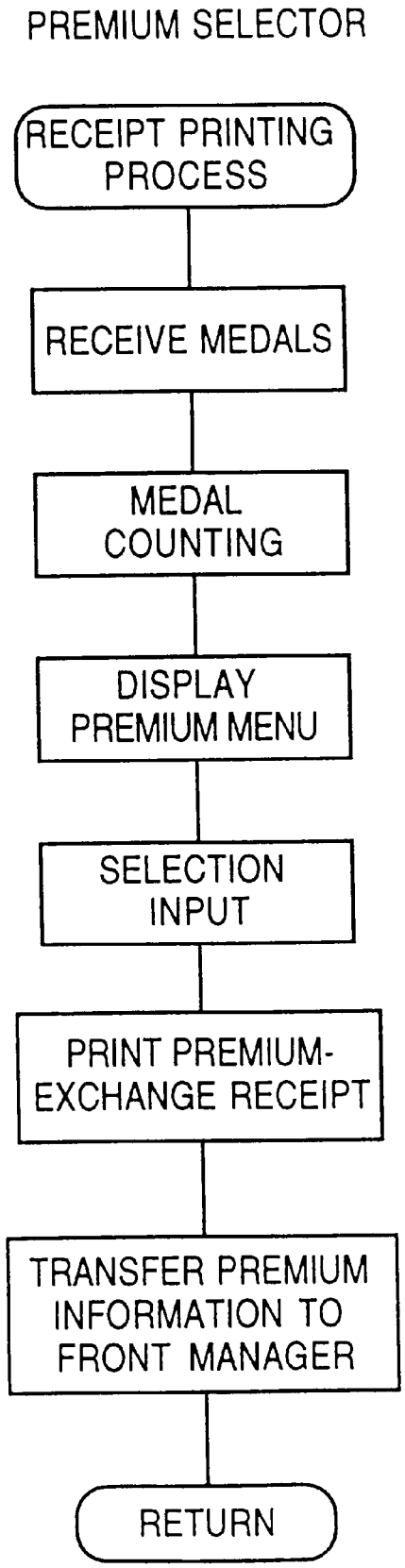
FIG. 12 is a flow chart showing the procedure of processing by the premium selector.

FIG. 12 is a flow chart showing the procedure of processing by the premium selector. First, the premium selector accepts medals, identifies the types of the medals, and performs counting as to regular medals. Then, as shown in FIG. 9, the premium selector presents a menu display of exchangeable premiums responsive to the counted number of medals, and reads a selected premium. Subsequently, the premium selector prints out a exchange receipt for the selected premium while it simultaneously transfers information on the selected premium to the front manager. Responsive to this, the front manager displays onto the CRT the information on the selected premium. Thus, the front clerk provides for the premium exchange.

Figure 13:
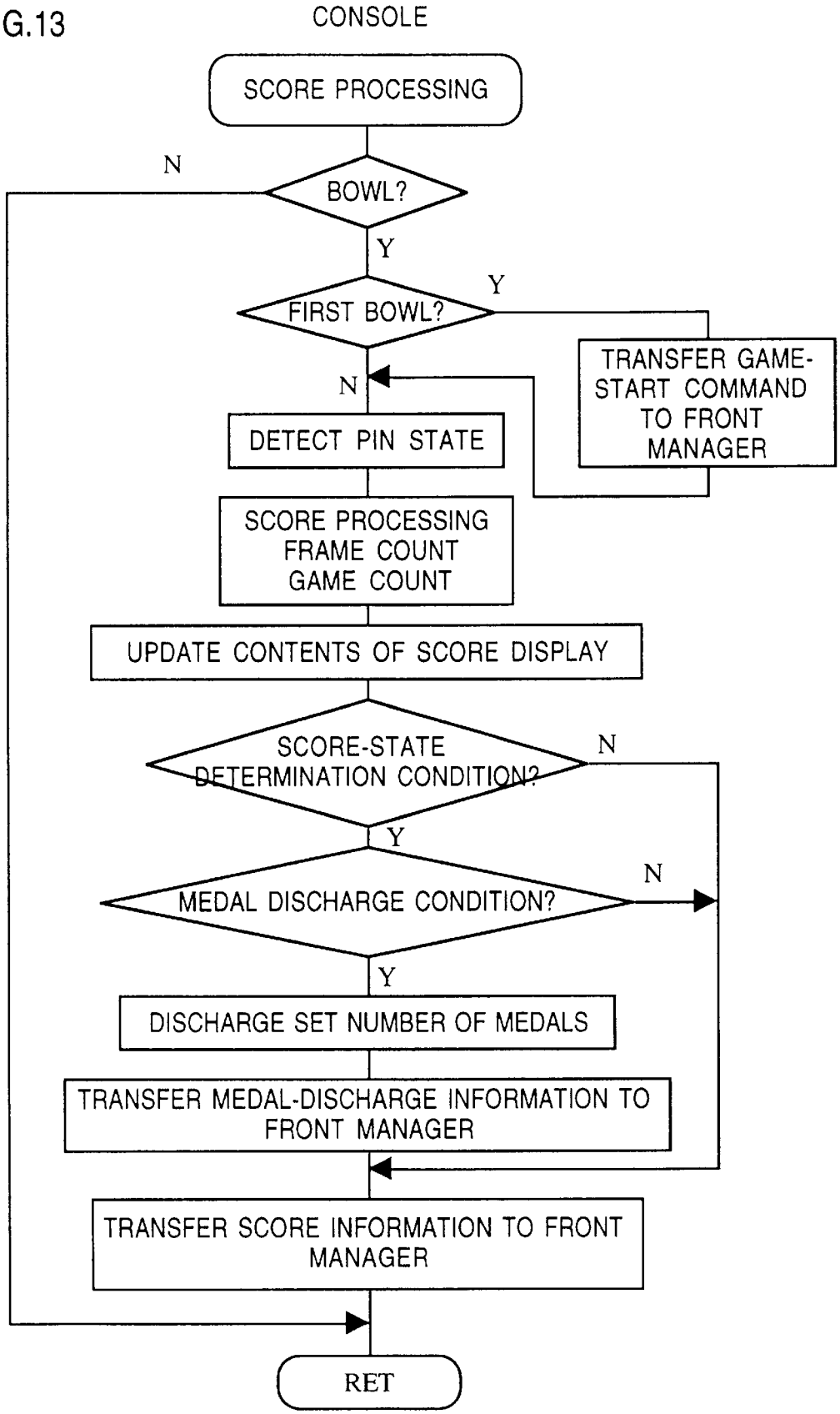
FIG. 13 is a flow chart showing the procedure of score processing by the console according to the second embodiment.

Next, with the console of an automatic bowling scoring apparatus which is a second embodiment of the invention, the procedure of score processing is shown as a flow chart in FIG. 13. This second embodiment is arranged not to discharge medals when a game is completed, but to discharge medals when the score state has come to a predetermined state. More specifically, first, upon the first bowl, the console transfers a game-start command to the front manager. The console detects the pin state after each bowl, and executes the score processing, the counting of frame number or the counting of game number based on the detection result. Subsequently, responsive to the processing result, the console updates the contents of score display. For example, the console decrements the number of medals at a time point of determining the score state (at a time point when the conditions for determining the score state have been satisfied), such as when oneframe bowls have been completed. Then, the console discharges a specified number of medals if the determined number of medals is other than 0. Thereafter, the console transfers to the front manager the number of discharged medals and the score information.

Next, the arrangement of an automatic bowling scoring apparatus which is a third embodiment of the invention is explained with reference to FIGS. 14 and 15.

Figure 14A:
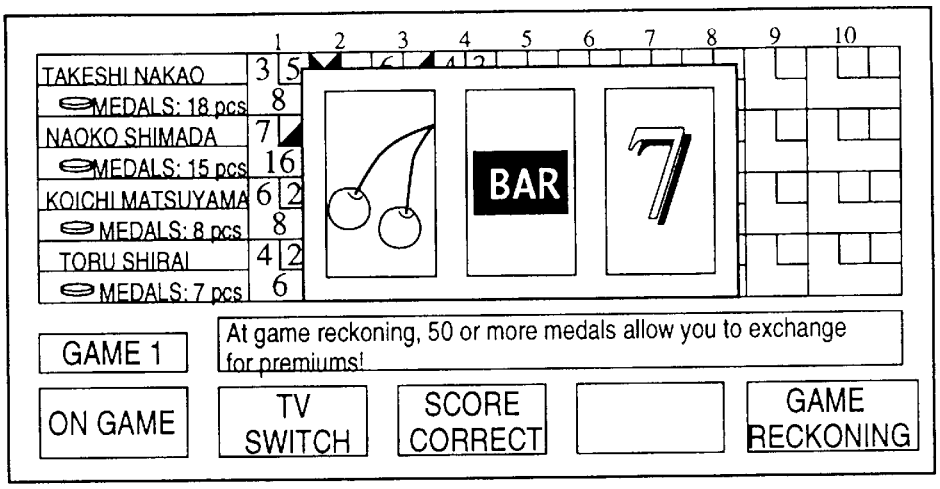
FIGS. 14A, 14B are views showing display examples on the console according to the third embodiment.
Figure 14B:
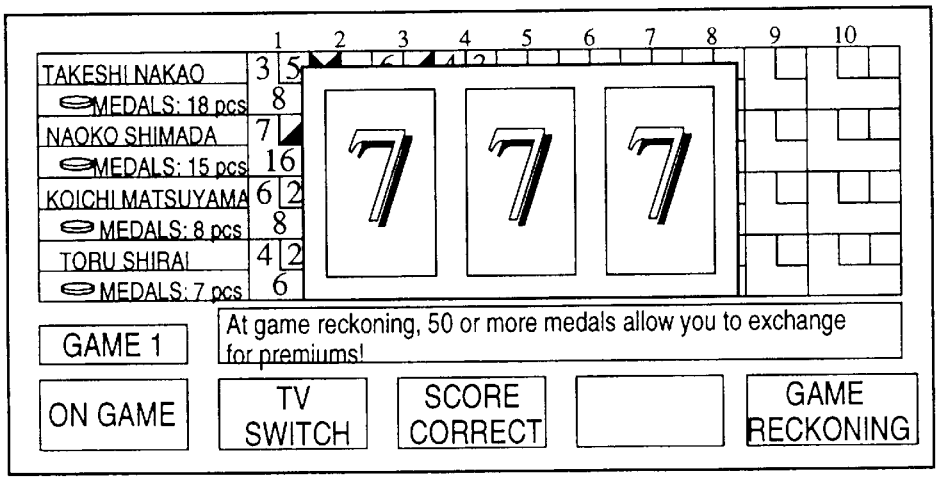

FIGS. 14A and 14B are views showing display examples on the console. These are examples of slot machine display to be displayed when a bowl has resulted in a strike, where points corresponding to a number of medals will not be added in the case of FIG. 14A, but points will be added when a predetermined specific state has come up, as shown in FIG.

14B, followed by discharging medals responsive to the resulting value of the points.

Figure 15:
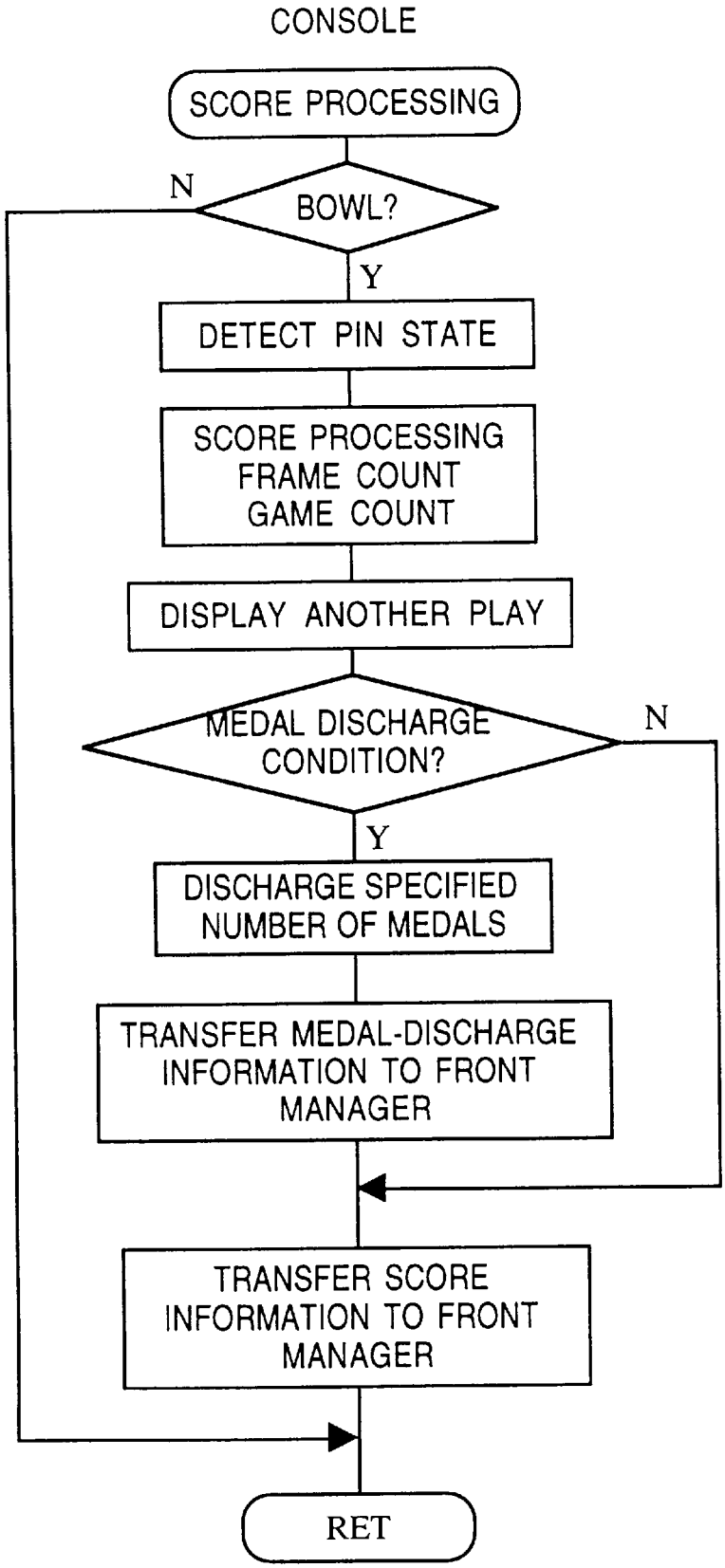
FIG. 15 is a flow chart showing the procedure of score processing by the console according to the third embodiment.

FIG. 15 is a flow chart showing the procedure of score processing by the console. First, upon a bowl, the console detects the pin state, and executes the score processing, the counting of frame number or the counting of game number based on the detection result. Subsequently, the console displays another amusement play as shown in FIGS. 14A and 14B. When the result of the play has satisfied a predetermined medal-discharging condition, the console discharges a specified number of medals, and transfers to the front manager the information on the number of the discharged medals. Thereafter, the console transfers the current score information to the front manager.

Figure 16:
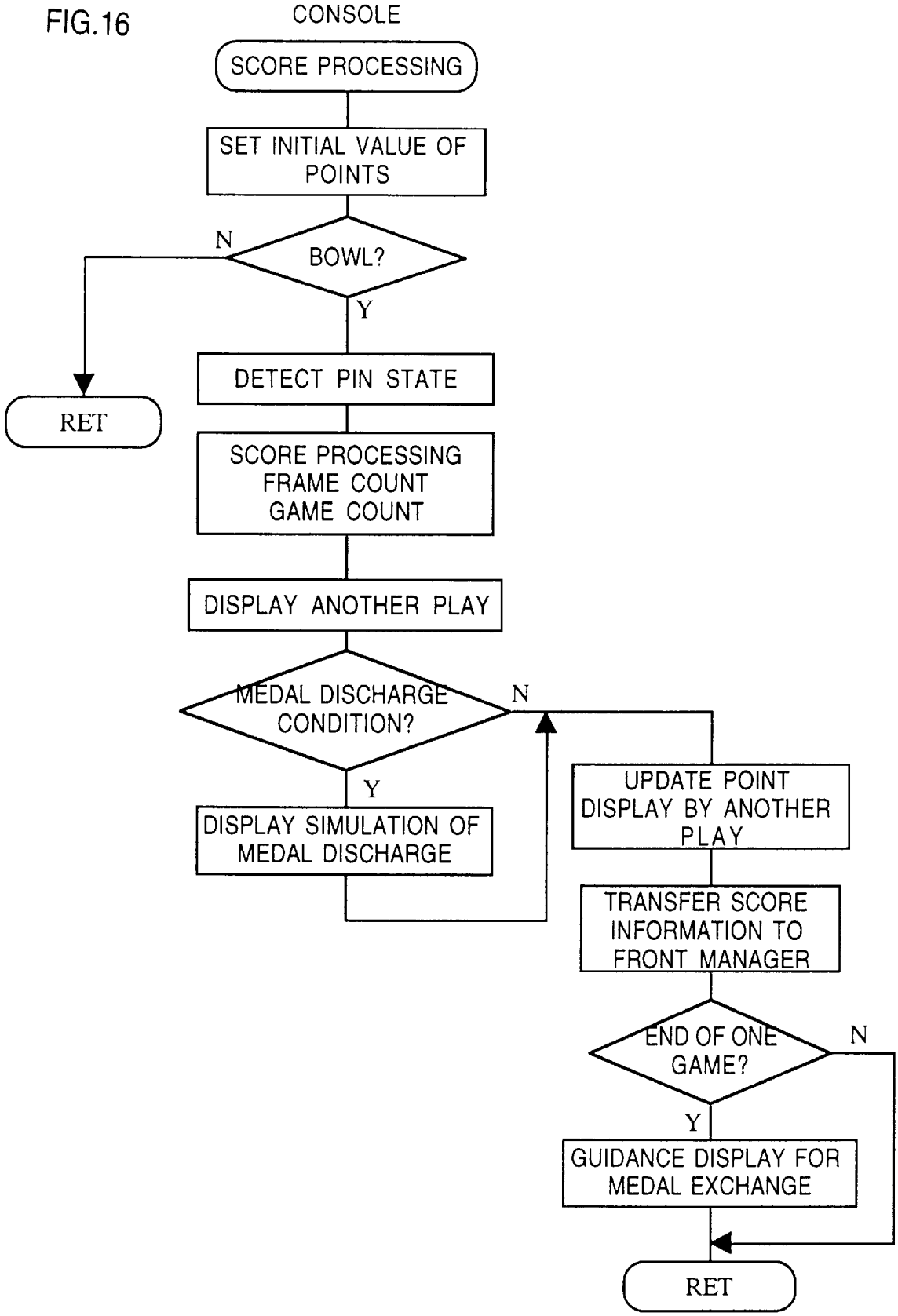
FIG. 16 is a flow chart showing the procedure of score processing by the console according to the fourth embodiment.

Next, with the console of an automatic bowling scoring apparatus which is a fourth embodiment of the invention, the procedure of score processing is shown as a flow chart in FIG. 16. First, the console sets the points (number of medals) of each bowler to an initial value (10). When the first bowl is effected, the console transfers a game-start command to the front manager. The console detects the pin state after each bowl, and executes the score processing, the counting of frame number or the counting of game number based on the detection result. Subsequently, the console presents a display of another amusement play as shown in FIGS. 14A and 14B. When the result of the play has satisfied a predetermined medal-discharging condition, the console presents a simulative display of discharging a specified number of medals as shown in FIGS. 7B and 7C, updating the point display (display of number of medals). Thereafter, the console transfers score information including the points to the front manager. Further, at a time point when one game has been completed, the console executes a guidance display for operating the medal key as shown in FIG. 8.

Figure 17:
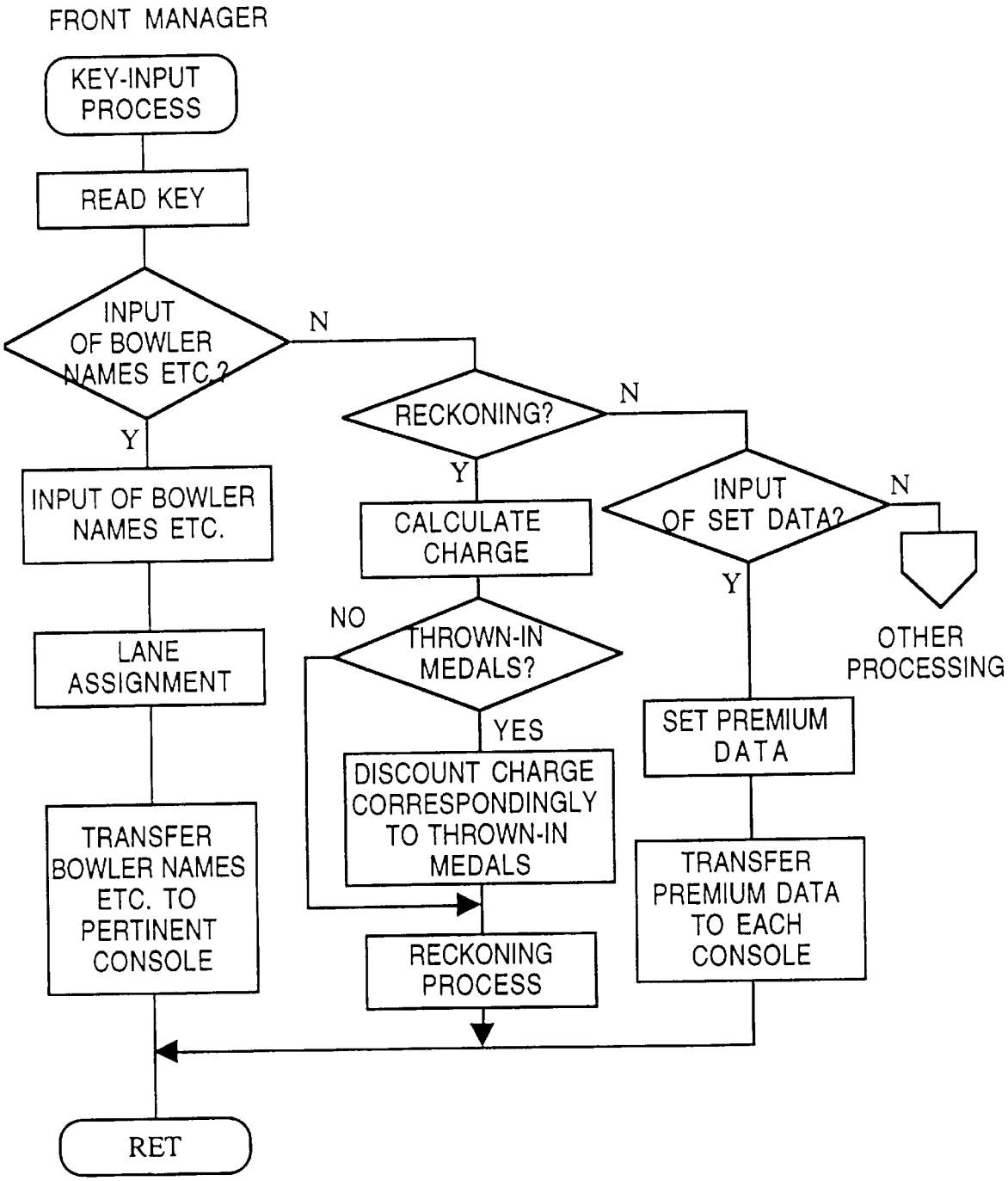
FIG. 17 is a flow chart showing the contents of key-input processing by the front manager according to the fifth embodiment.

Next, FIG. 17 shows a flow chart of key-input processing by the front manager equipped with means for reckoning the charge as a fifth embodiment of the invention. Upon some key operation, this front manager executes the processing responsive to the contents of the key operation. For example, when a key operation of inputting identification information for bowler names or the like is effected at the reception, the front manager enters this information and assigns a lane from among empty lanes. Then, the front manager transfers identification information such as the names of bowlers and the number of bowlers to the console of the assigned lane. Also, when a key operation for charge reckoning is effected, the front manager reckons the charge according to the number of bowling games that have been played in the pertinent lane. Thereafter, the front manager discounts the charge responsive to the number of medals that have been thrown into the medal counter provided to the front manager, thereby performing a reckoning process. Also, when a key operation for setting premium data, by which it is set how many medals are discharged in what state of score, is effected, the front manager executes the setting of the data while it transfers the premium data to each console. Thus, the setting of premium data is achieved on each console.

Next, the arrangement of a bowling alley management system which is a sixth embodiment of the invention is described below with reference to FIGS. 18 to 23.

Figure 18:
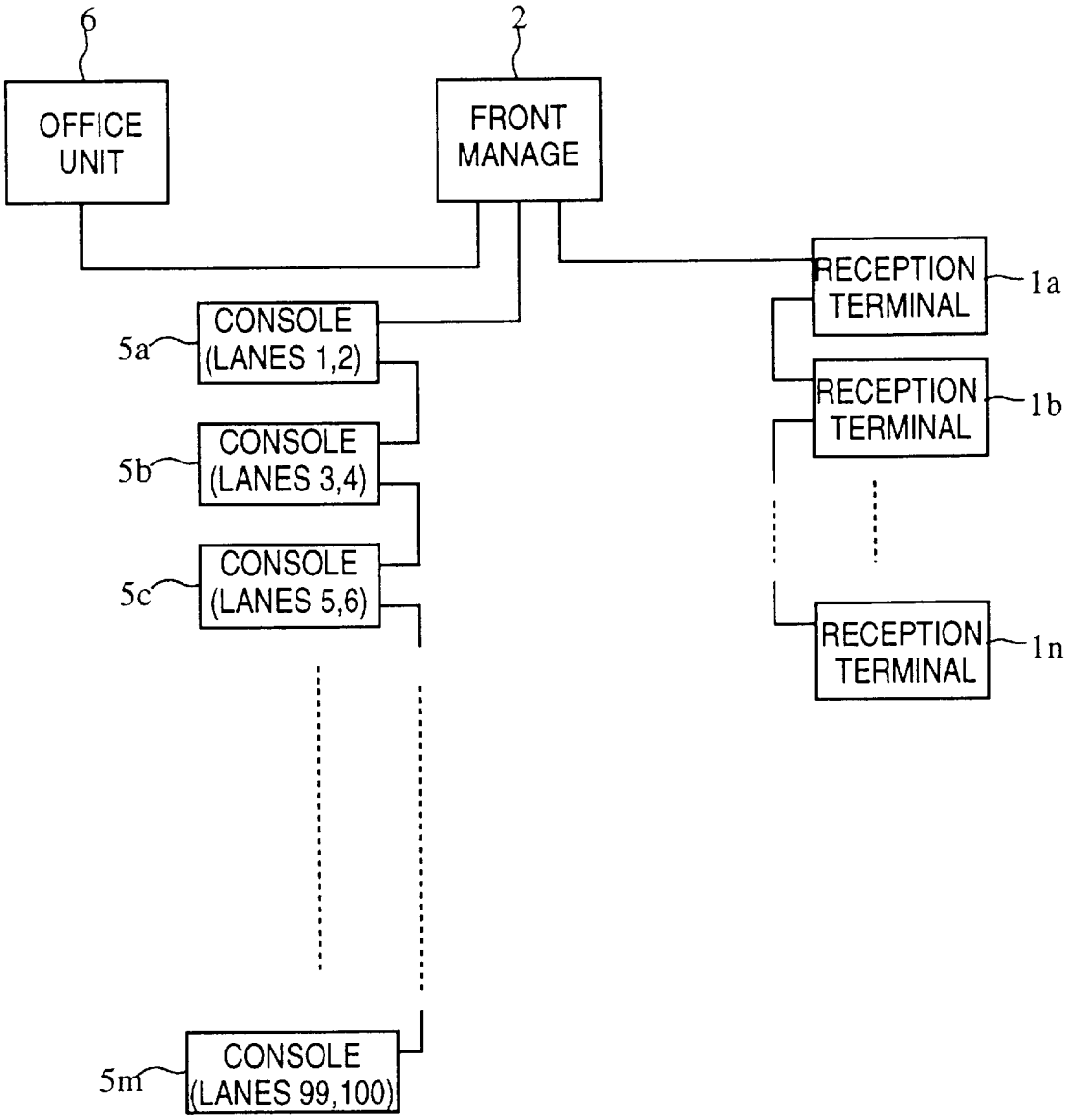
FIG. 18 is a block diagram showing the overall arrangement of a bowling alley management system according to the sixth embodiment.

FIG. 18 is a block diagram showing the overall arrangement of the bowling alley management system. In this bowling alley management system, a plurality of reception terminals 1*a*, 1*b*, . . . , in to be operated by bowlers that have come to the bowling alley, a front manager 2 provided at the front desk, consoles 5*a*, 5*b*, 5*c*, . . . , 5*m* provided for every two lanes, and an office unit 6 provided in the office are connected together via a local area network.

Figure 19:
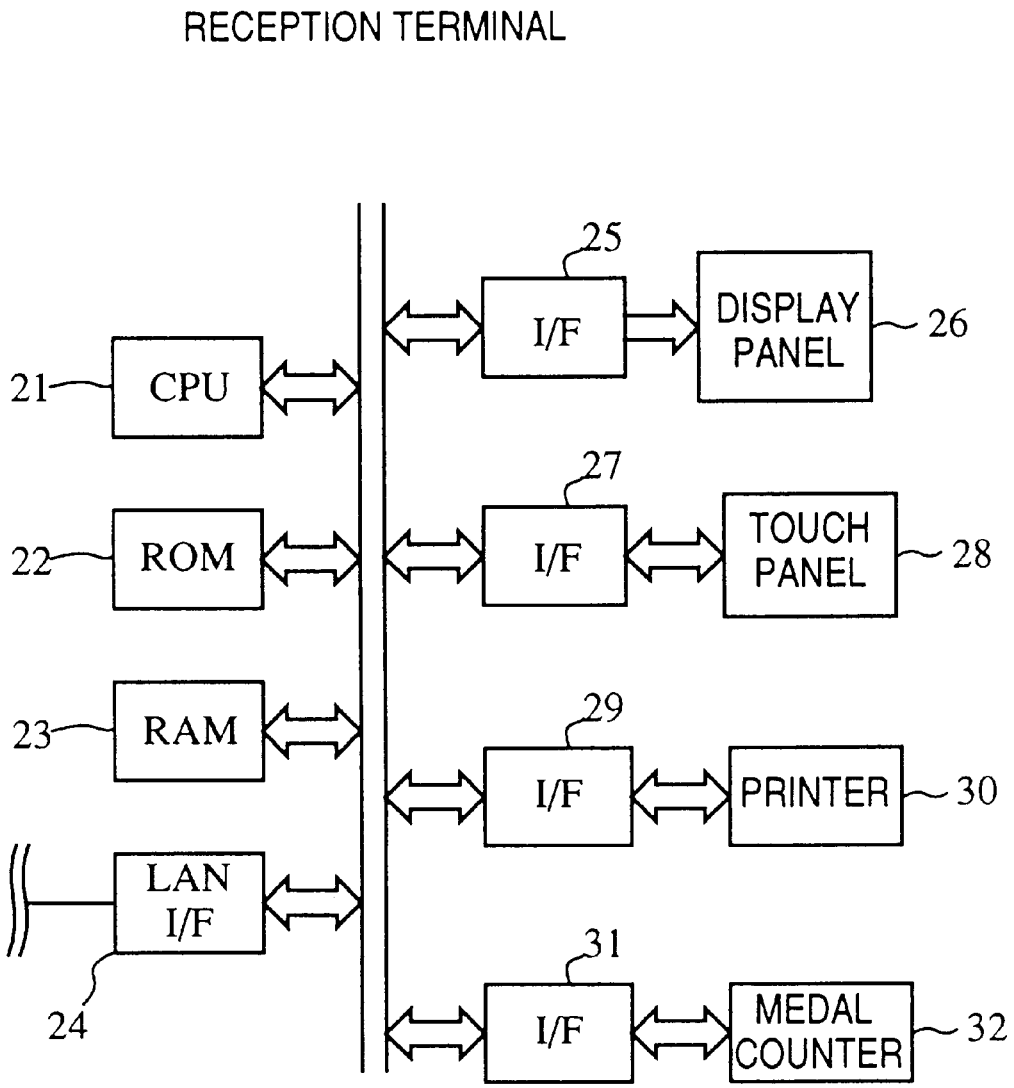
FIG. 19 is a block diagram showing the arrangement of a reception terminal.

FIG. 19 is a block diagram showing the arrangement of one reception terminal out of the reception terminals 1*a*, 1*b*, . . . , in shown in FIG. 18. Referring to FIG. 19, a CPU 21 executes programs previously written in a ROM 22. A RAM 23 is used as working areas for executing the temporary storage of identification information such as bowler names or other processes in the execution of the programs. A LAN interface 24 executes the transfer control of various data in conjunction with the front manager or the like via the local area network. A display panel 26 is used for a guidance display of input operation of bowler names and the like, where the CPU 21 executes display control via an interface 25. A touch panel 28 is provided so as to be flush with the display panel 26, where the CPU 21 reads a touch position of the panel via an interface 27 and executes the input of bowler names and the like. A printer 30 prints lane sheets and reservation sheets, where the CPU 21 outputs print data via an interface 29. A medal counter 32 is a device for accepting medals for use in medal amusement equipment and counting the types and number of the medals, where the CPU 21 inputs those data via an interface 31.

Figure 20:
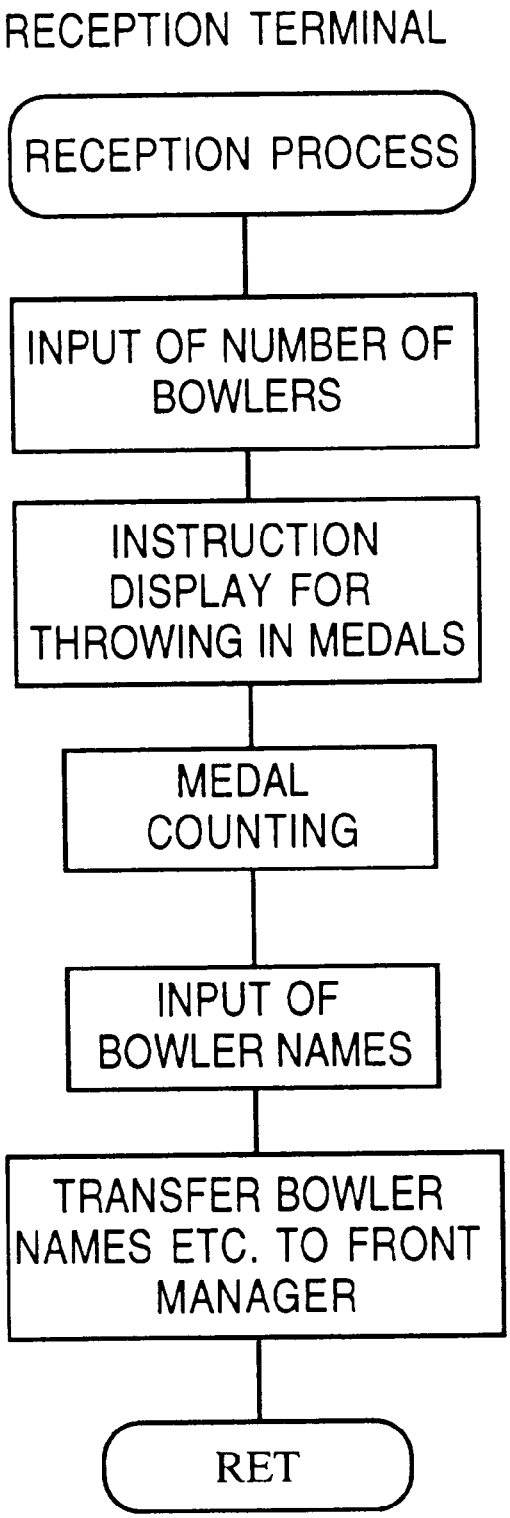
FIG. 20 is a flow chart showing the procedure of processing by the reception terminal.

FIG. 20 is a flow chart showing the procedure of reception processing by the reception terminal. First, the reception terminal executes the input of the number of people that play the games at one lane, the display of a message for throwing in medals, and awaits the throw-in of medals. When medals necessary for each bowler to play one game are thrown in, the reception terminal executes the input of identification information such as the number and names of bowlers, and transfers the information to the front manager.

Figure 21:
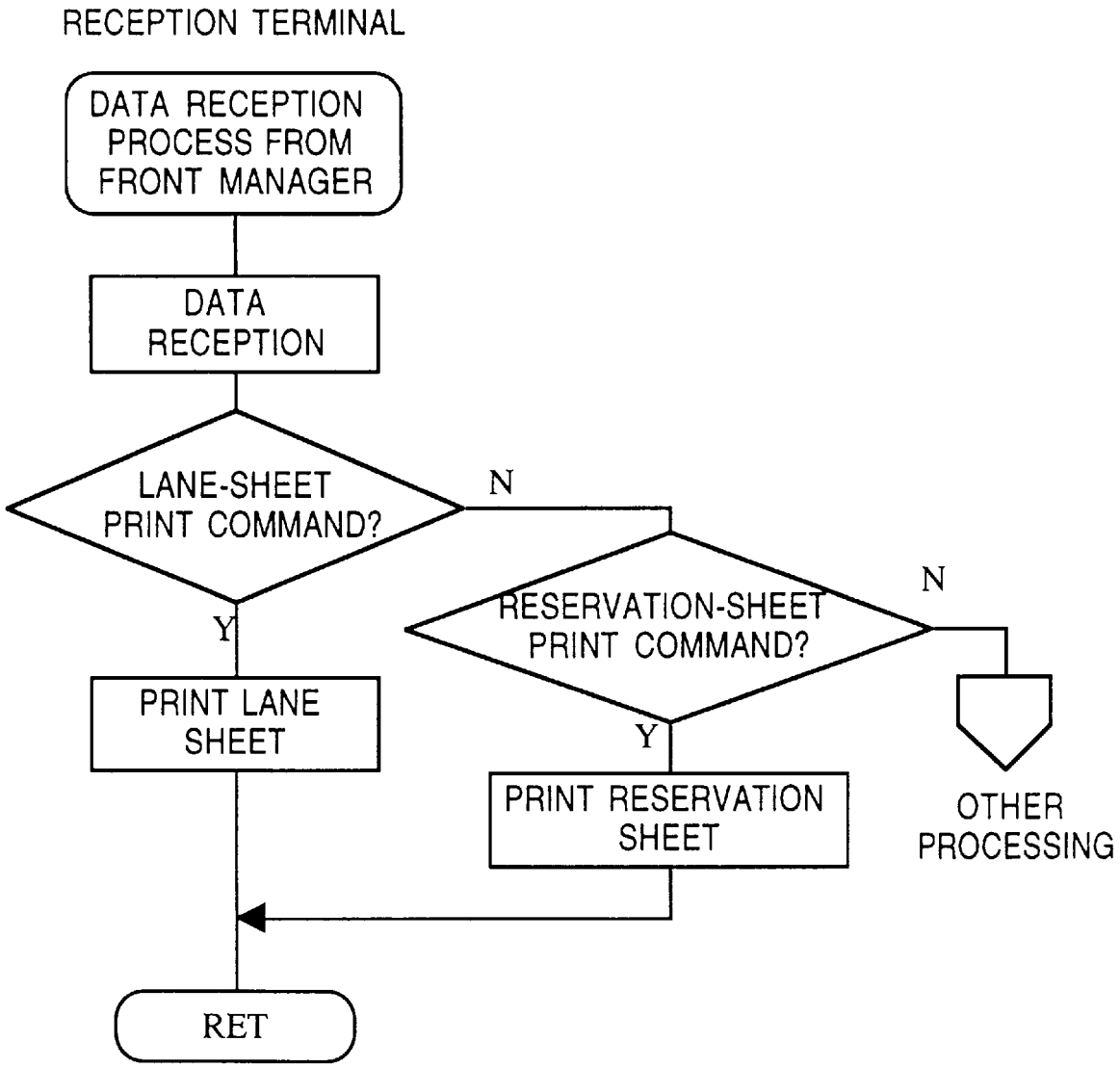
FIG. 21 is a flow chart showing the procedure of processing by the reception terminal.

FIG. 21 is a flow chart showing the contents of processing by the reception terminal during the reception of data from the front manager. Upon receiving a lane-sheet print command from the front manager, the reception terminal prints a lane sheet responsive to the command. This lane sheet shows which lane the game should be started at, based on the result of the processes that the reception terminal has transferred bowler names to the front manager and that the front manager has assigned a lane out of empty lanes. If there are no empty lanes, the reception terminal receives a reservation-sheet print command from the front manager and prints a reservation sheet. Once the lane sheet has been printed during the reception by the reception terminal, the bowlers are allowed to immediately start playing the game in a lane pertinent to the number printed on the lane sheet. If the reservation sheet is printed, the bowlers are supposed to wait until a call is made.

Figure 22:
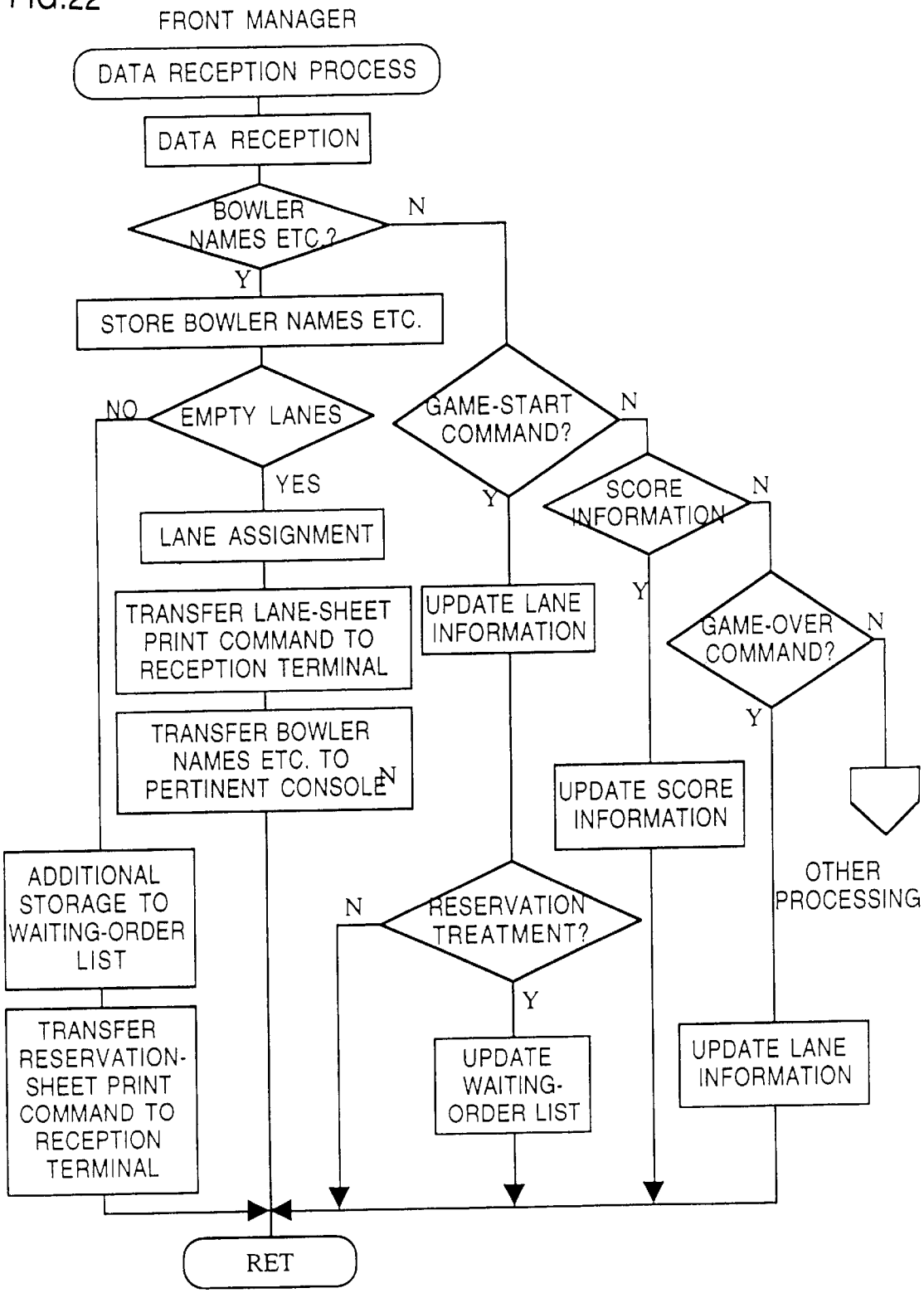
FIG. 22 is a flow chart showing the procedure of processing by the front manager.

FIG. 22 is a flow chart showing the contents of processing by the front manager during the data reception. First, when the front manager has received identification information such as bowler names and number of bowlers from the reception terminal, the front manager stores those data, where if there is any empty lane, the front manager executes lane assignment and transfers to the reception terminal a command for printing a lane sheet containing the assigned lane number. Further, the front manager transfers identification information such as the bowler names to the pertinent console. If there is no empty lane left, the front manager adds and stores the identification information onto a waiting-order list, and transfers to the reception terminal a command for printing the reservation sheet. Also, upon receiving a game-start command from the console, the front manager updates lane information and stores the fact that the game has been started at the lane. Then, in the case where the bowlers that have started playing the game at the lane are from reservation treatment, the front manager updates the waiting-order list. Further, upon receiving score information from the console, the front manager updates score information at the lane, while upon receiving a game-over command, the front manager updates lane information, that is, the front manager regards the lane as an empty lane.

Figure 23:
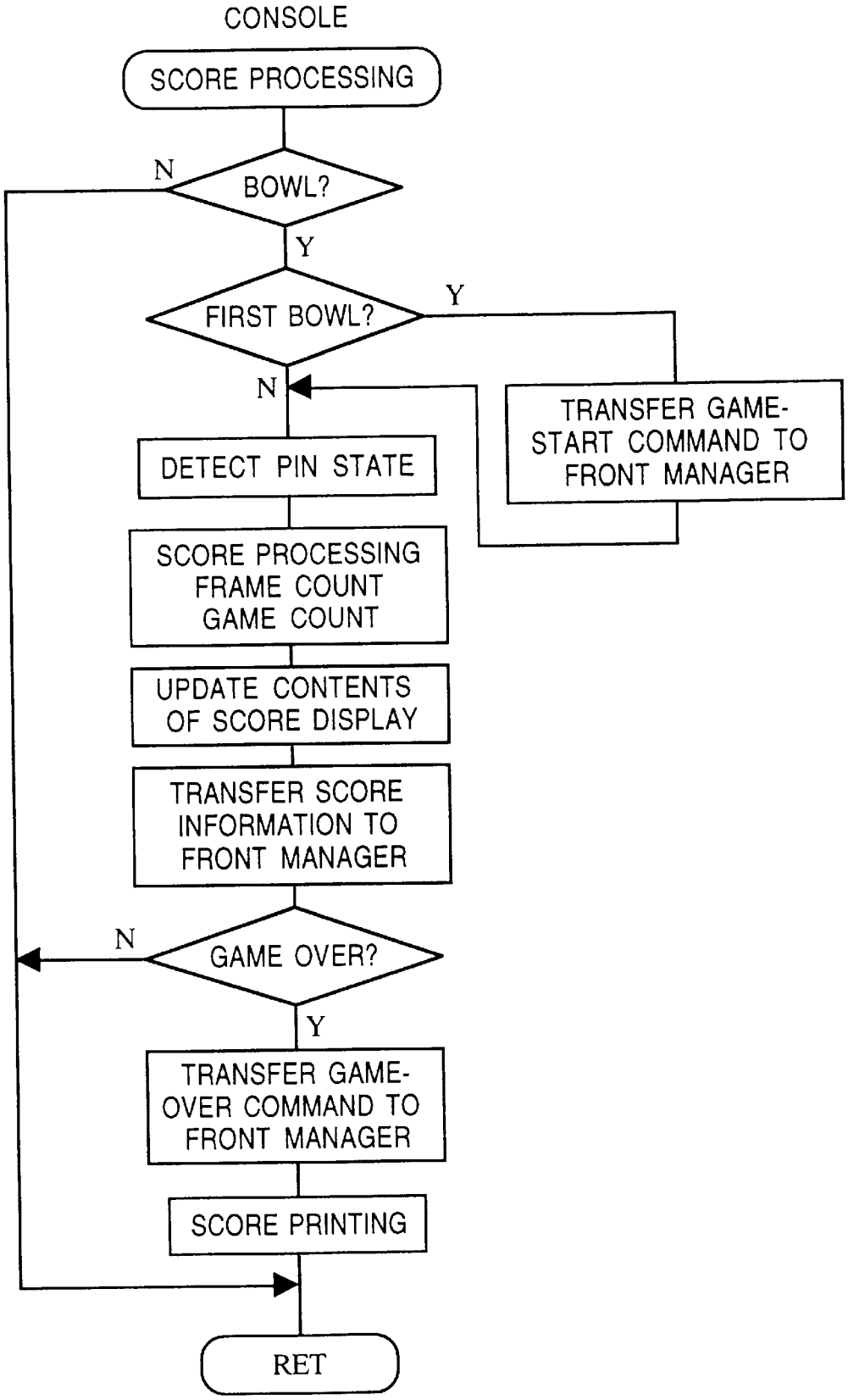
FIG. 23 is a flow chart showing the procedure of processing by the console.

FIG. 23 is a flow chart showing the procedure of score processing by the console. First, when the first bowl is effected, the console transfers a game-start command to the front manager. The console detects the pin state after each bowl, and executes the score processing, the counting of frame number or the counting of game number based on the detection result. Subsequently, responsive to the processing result, the console updates the contents of score display and transfers score information to the front manager. The console iterates these processes until each of the bowlers completes one game. At an end of the game, the console automatically transfers a game-over command to the front manager, while it executes score printing. Thus, the front manager is notified that the game at the lane has been completed. In this way, the bowlers are allowed to leave the bowling alley without paying the charge at the front desk.

The sixth embodiment of the invention has been described above on a case where reception terminals for use of reception are provided. However, it is also possible that the front manager is provided with a device for counting thrown-in medals, and the front clerk executes the operation for reception with the device.

Next, the arrangement of a bowling alley management system which is a seventh embodiment of the invention is described below with reference to FIGS. 24 to 27.

Figure 24:
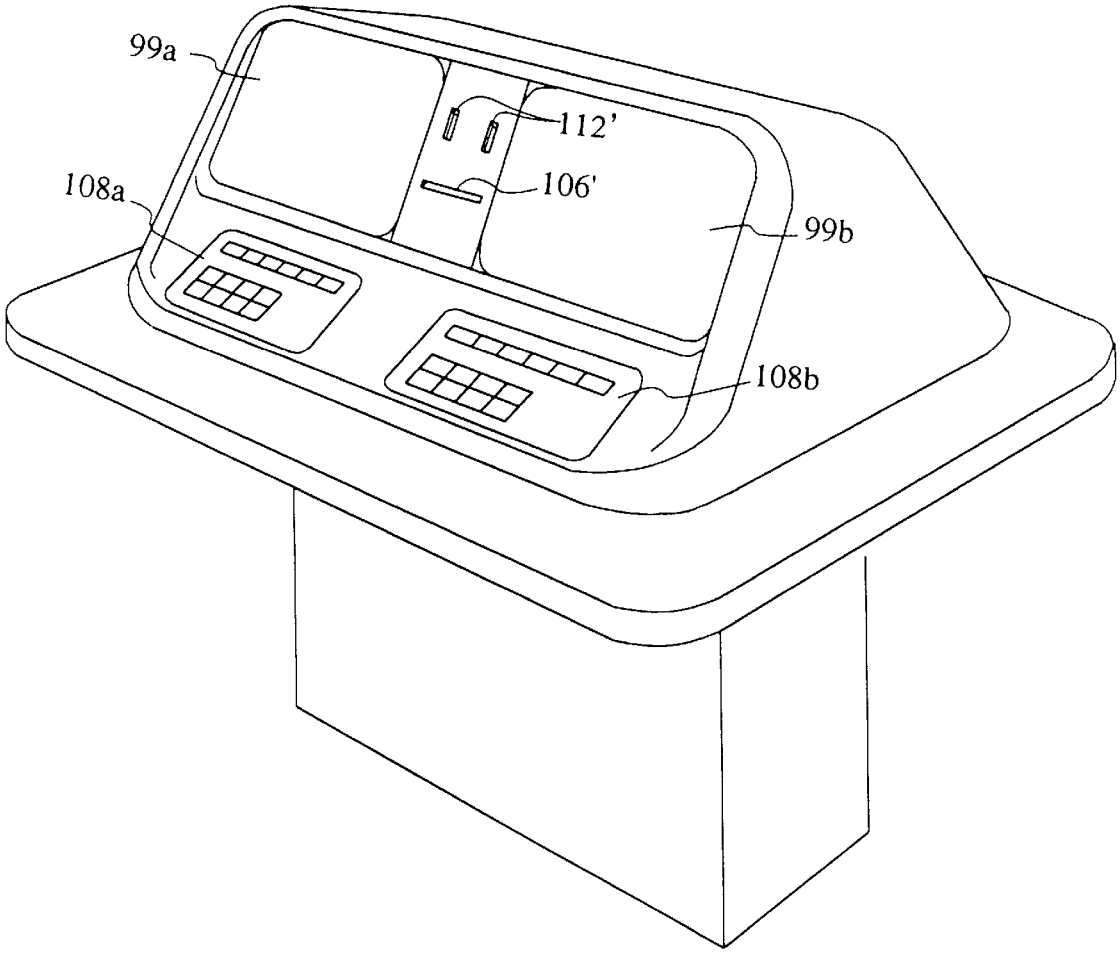
FIG. 24 is an appearance perspective view of the console according to the seventh embodiment.

FIG. 24 is an appearance perspective view showing the arrangement of one console corresponding to the automatic bowling scoring apparatus. Referring to FIG. 24, numerals 99*a*, 99*b* each denote a CRT for displaying the score and displaying, for example, that the score has come to a predetermined specific state, and numerals 108*a*, 108*b* each denote a keyboard used for the correction of the names of bowlers, the correction of the score, and the like. Two slots denoted by numeral 112' are medal throw-in openings, respectively. As will be described later, throwing in medals through these medal throw-in openings allow bowlers to immediately start playing the bowling game.

Figure 25:
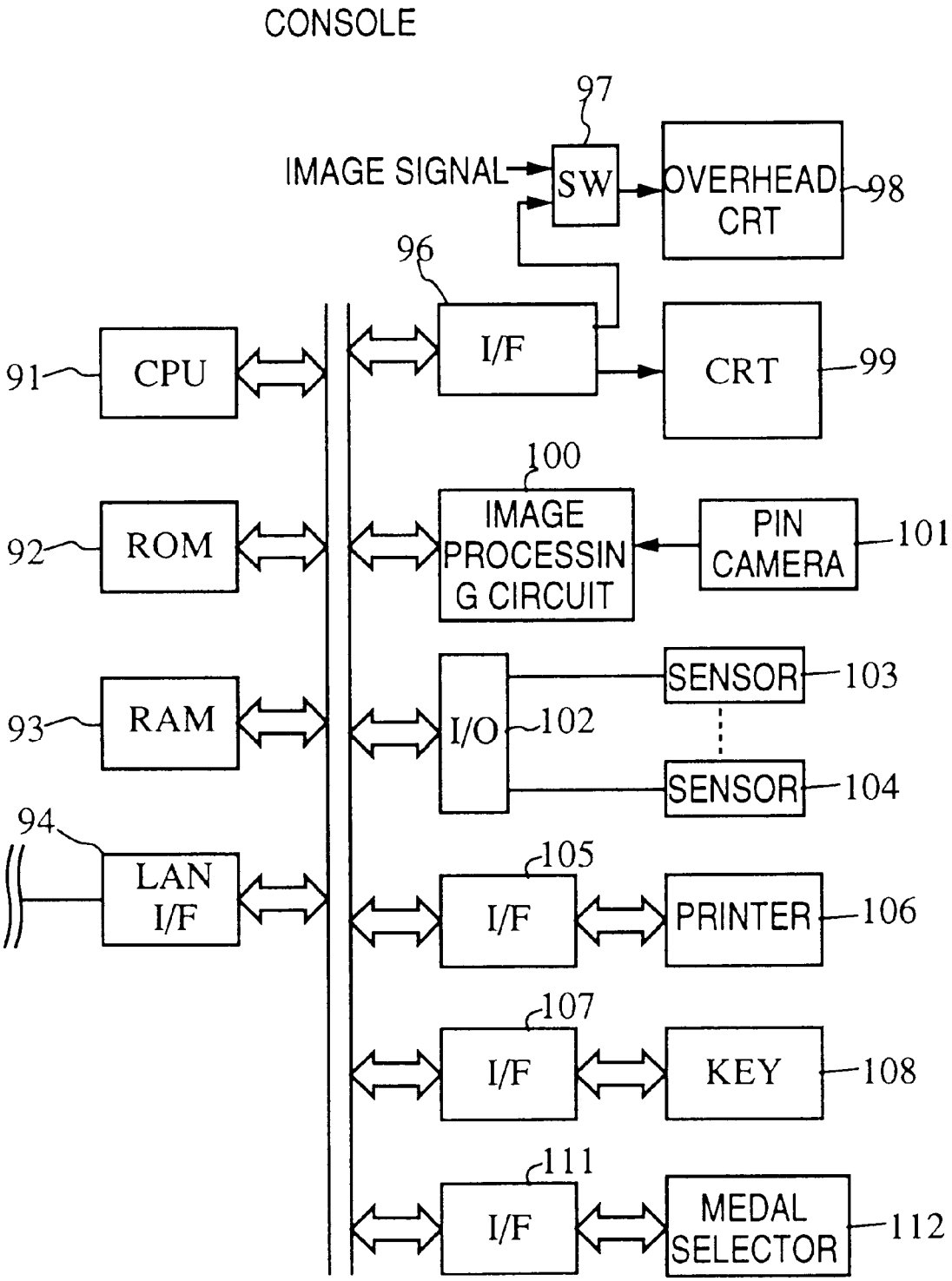
FIG. 25 is a block diagram showing the arrangement of the console according to the seventh embodiment.

FIG. 25 is a block diagram of a part of the console that executes the score processing for one lane. This arrangement differs from the arrangement of the console shown in FIG. 4 in that a medal selector 112 and an interface 111 therefor are provided. This medal selector 112 determines the types of medals thrown in through the medal throw-in openings 112' shown in FIG. 24. The CPU 91 counts the number of thrown-in regular medals.

Figure 26:
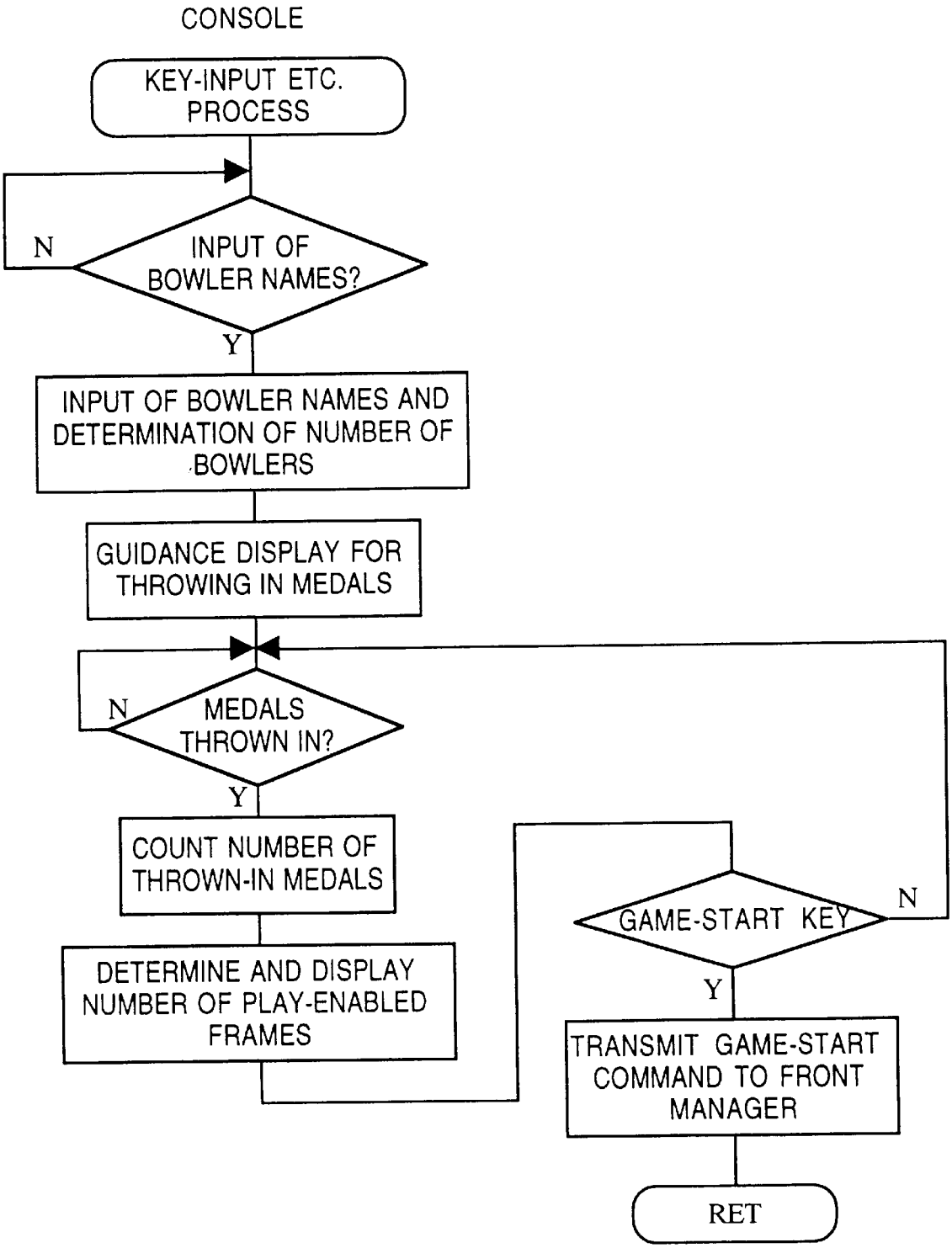
FIG. 26 is a flow chart showing the contents of key-input and other processing by the console.

FIG. 26 is a flow chart showing the procedure of key-input and other processing by the console. First, upon input of the names of bowlers, the console reads the data and determines the number of bowlers. Then, the console displays the number of medals necessary for each bowler to play one game and besides presents a guidance display for a message for throwing in medals. With medals thrown in, the console counts the medals, determines the number of frames that can be played responsive to the total number of thrown-in medals, and displays the number of the frames. Thereafter, when the game-start key is operated, the console transmits a game-start command to the front manager.

Figure 27:
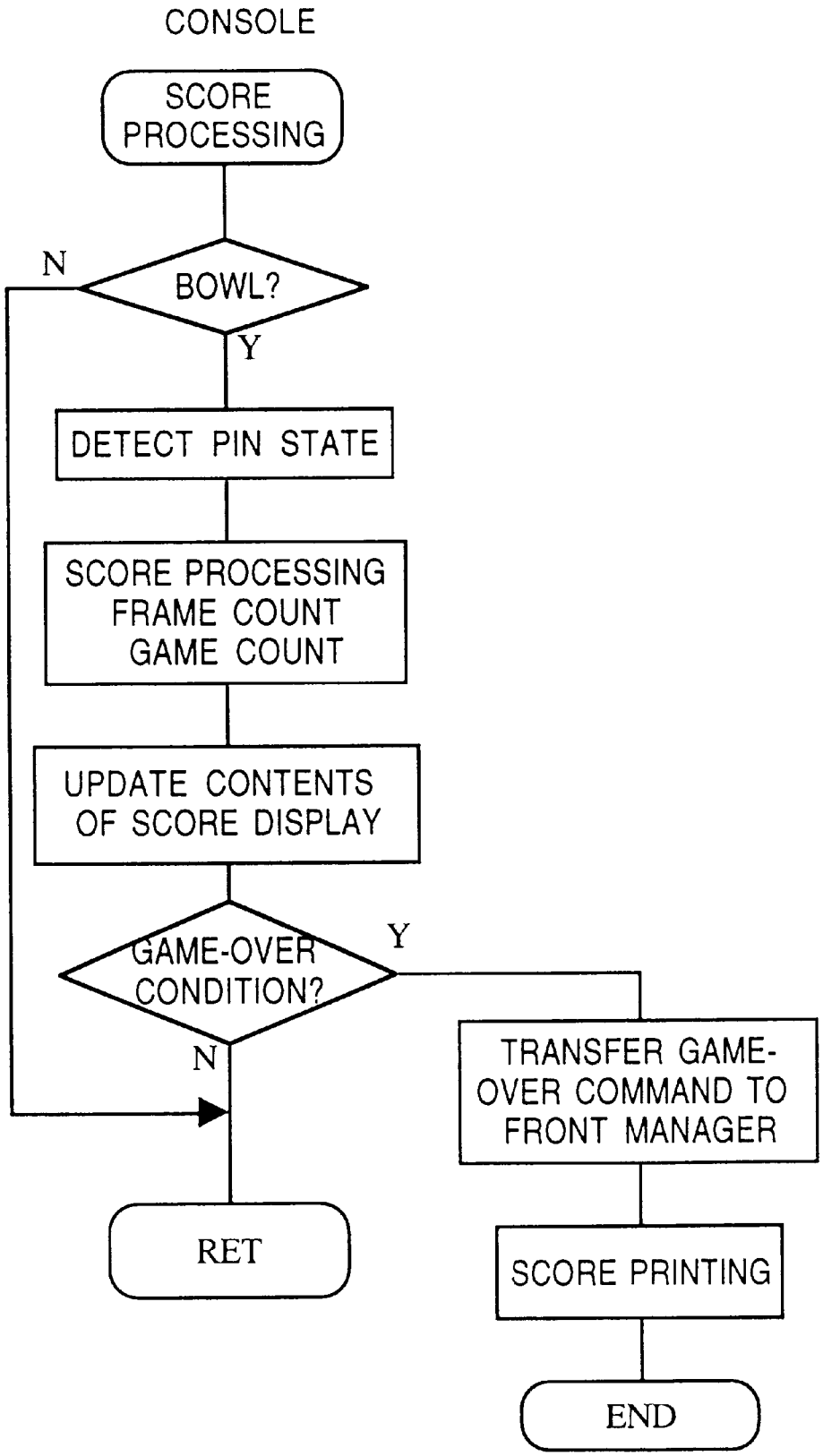
FIG. 27 is a flow chart showing the procedure of score processing by the console.

FIG. 27 is a flow chart showing the procedure of score processing by the console. First, upon a bowl, the console detects the pin state, and executes the score processing, the counting of frame number or the counting of game number based on the detection result. Subsequently, responsive to the processing result, the console updates the contents of score display and determines whether or not the games corresponding to the number of frames responsive to the number of previously thrown-in medals have been completed. When the games corresponding to the number of frames responsive to the number of medals are completed, the console transmits a game-over command to the front manager, and executes score printing. In this way, the bowlers are allowed to leave the bowling alley without paying the charge at the front desk.

The first to fourth embodiments have been described above, showing cases where the medals discharged from the console are used in the medal game machine or where the medals are exchanged for a premium. Further, the sixth and seventh embodiments have been described, showing cases where bowlers are enabled to play the bowling game by throwing medals into the reception terminal or the console. Now, combining the first to fourth embodiments and the sixth and seventh embodiments with one another makes it possible to provide a medal hopper and a medal selector on the console. With such an arrangement, for example if 53 medals are discharged from the console, it is possible to exchange 50 medals for a premium and throw in the remaining 3 medals into the console. This allows the bowlers to play three frames of a bowling game responsive to three medals.

In the embodiments described hereinabove, a case has been shown where medals to be used for medal game machines are used as a medium. If amusement equipment in which data of points by the amusement play or the like are written into IC cards or magnetic information storage devices are available for the bowlers in the bowling alley, IC information storage devices or magnetic cards or the like may be used as a medium instead of the medals. In such a case, the console is provided with a card writer in place of the medal hopper and a card reader in place of the medal selector, while the premium selector, the reception terminals, and the front manager are each provided with a card reader in place of the medal counter.

According to the present invention, for example, the discharge of medals to be used in medal game machines or the like, the writing of point information into a magnetic card, and other processes are executed when the score state of a bowling game determined by detecting a passage of a ball and the resulting pin state at the lane has come to a predetermined state, such as upon a strike or a spare or a coincidence of the score pattern with a predetermined pattern. Accordingly, with the use of a medium obtained in this way, the bowlers are allowed to play an amusement game with any of amusement equipment laid out on a floor same as or different from the floor on which the bowling game equipment is provided. This can arouse bowlers' passion for gambling and appeal to actual profits for the bowlers, so as to enhance the excitement of the bowling game.

Also, points other than the score of the bowling game are increased or decreased each time the score state of the bowling game determined by detecting a passage of a ball and the resulting pin state at the lane has come to a predetermined state, such as upon a strike or a spare or a coincidence of the score pattern with a predetermined pattern. Then, responsive to the total points at an end of the game, for example, medals to be used in medal game machines are discharged and point data is written into the magnetic card. With the use of a medium obtained in this way, the bowlers are allowed to play an amusement game with any of amusement equipment laid out on a floor same as or different from the floor on which the bowling game equipment is provided. This can arouse bowlers' passion for gambling and appeal to actual profits for the bowlers, so as to enhance the excitement of the bowling game.

Further, according to the present invention, since the increased or decreased state of points is added to the contents of score display, the bowlers are allowed to easily confirm the increased or decreased state of points as well as the contents of the score itself. This can enhance the excitement of the bowling game.

Further, according to the present invention, an amusement play such as slot machine, roulette, and sugoroku (a Japanese variety of Parcheesi) other than the bowling game is displayed on a displaying device in response to the score state or the pin state. When the result of the amusement play has come to a predetermined state, for example, medals to be used in medal game machines are discharged and point data is written into the magnetic card or the like. Accordingly, with the use of a medium obtained in this way, the bowlers are allowed to play an amusement game with any of amusement equipment laid out on a floor same as or different from the floor on which the bowling game equipment is provided. This can arouse bowlers' passion for gambling and appeal to actual profits for the bowlers, so as to enhance the excitement of the bowling game.

Further, according to the present invention, when the bowling games have been completed, for example, medals to be used in medal game machines are discharged or point data is written into the magnetic card or the like, in response to the playing result of the another amusement play. Accordingly, with the use of a medium obtained in this way, the bowlers are allowed to play an amusement game with any of amusement equipment laid out on a floor same as or different from the floor on which the bowling game equipment is provided. This can arouse bowlers' passion for gambling and appeal to actual profits for the bowlers, so as to enhance the excitement of the bowling game.

Further, according to the present invention, since points other than the score of the bowling game are increased or decreased in response to the playing contents of the another amusement play and the resulting increased or decreased state of points is added to the contents of score display, the bowlers are allowed to easily confirm the increased or decreased state of points as well as the contents of the score itself. This can enhance the excitement of the bowling game.

Further, according to the present invention, when a medium discharged from the automatic bowling scoring apparatus is thrown into the premium selector, a screen for selecting from among a plurality of premiums is displayed responsive to the value of the medium, in which screen when a premium is selected, an exchange sheet for the corresponding premium is printed out. Also, when a medium discharged from the automatic bowling scoring apparatus is thrown into the premium selector, a screen for selecting from among a plurality of premiums is displayed responsive to the value of the medium, in which screen when a premium is selected, identification information for the corresponding premium is transferred to the front manager. As a result, the bowlers are allowed to receive the actual premium. In this way, the enjoyment of the bowling game is increased with the aim of premiums, so that the bowlers are attracted to the bowling alley. Besides, since the procedure of premium exchange is partly automated, the working burden on the bowling alley side is reduced.

Further, according to the present invention, since the charge reckoning for bowling games is carried out by using the medium obtained from amusement equipment other than bowling game equipment, it becomes possible to systematically combine amusement equipment other than bowling game equipment and the bowling game equipment with each other. This contributes to the improvement in the service for bowlers.

Further, according to the present invention, the charge for games can be paid with the medium used in amusement equipment other than bowling game equipment, and the lane assignment or the waiting-order management is treated with the medium. Therefore, the bowlers are allowed to use the bowling alley with the medium. Also since the charge reckoning is no longer needed after the end of the bowling games, the bowlers become free to enjoy playing the bowling game.

Further, according to the present invention, a medium used in amusement equipment other than bowling game equipment can be accepted, and the score counting is done in correspondence to the game number or frame number responsive to the value of the accepted medium. Therefore, the bowlers are allowed to immediately start playing the bowling game with the medium. Also since the charge reckoning is no longer needed after the end of the bowling games, the bowlers become free to enjoy playing the bowling game.

What is claimed is:

1. An automatic bowling scoring apparatus comprising:

a score counter for counting a score of a bowling game by detecting a passage of a ball and a pin state in a lane; and a medium operator for writing information based on the score of the score counter into a medium when the score of the score counter has come to a predetermined state or when the bowling game is ended.

2. An automatic bowling scoring apparatus comprising:

a score counter for counting a score of a bowling game by detecting a passage of a ball and a pin state in a lane; and a medium operator for increasing or decreasing a score other than the bowling game score when the score of the score counter has come to a predetermined state, and for discharging a medium used in amusement equipment or writing information based on the score of the score counter into a medium when the score of the score counter has come to a predetermined state or when the bowling game is ended.

3. An automatic bowling scoring apparatus comprising:

a score counter for counting a score of a bowling game by detecting a passage of a ball and a pin state in a lane; and means for increasing or decreasing a score other than the bowling game score when the score of the score counter has come to a predetermined state, and for adding the increased or decreased state to contents of a score display.

4. An automatic bowling scoring apparatus comprising:

a pin-state detector for detecting a pin state after a bowl of a ball in a lane;

a score counter for counting a score of a bowling game based on a detection result by the pin-state detector;

a displaying device for displaying the score of the score counter;

an amusement-play displaying device for displaying another amusement play onto the displaying device in response to the score of the score counter or the detection result of the pin-state detector coming to a predetermined state; and a medium operator for discharging a medium used in amusement equipment or writing information based on the score of the score counter into a medium when a result of the amusement play displayed by the amusement-play displaying means has come to a predetermined state.

5. An automatic bowling scoring apparatus comprising:

a pin-state detector for detecting a pin state after a bowl of a ball in a lane;

a score counter for counting a score of a bowling game based on a detection result by the pin-state detector;

a displaying device for displaying the score of the score counter;

an amusement-play displaying device for displaying another amusement play onto the displaying device in response to the score of the score counter or the detection result of the pin-state detector coming to a predetermined state; and a medium operator for discharging a medium corresponding to the playing result of the amusement play displayed by the amusement-play displaying device and used in amusement equipment or writing information corresponding to the result of the amusement play displayed by the amusement-play displaying device into a medium when the bowling game is ended.

6. An automatic bowling scoring apparatus comprising:

a pin-state detector for detecting a pin state after a bowl of a ball in a lane;

a score counter for counting a score of a bowling game based on a detection result by the pin-state detector;

a displaying device for displaying the score of the score counter;

an amusement-play displaying device for displaying another amusement play onto the displaying device in response to the score of the score counter or the detection result of the pin-state detector coming to a predetermined state; and an adder for increasing or decreasing a score other than the bowling game score in response to playing contents of the amusement play displayed by the amusement-play displaying device and adding said other score to contents of a score display.

7. A bowling alley management system comprising:

the automatic bowling scoring apparatus as defined in claim 1, 2, 4 or 5; and a premium selecting device including a display for, upon receiving the medium, displaying a plurality of premiums corresponding to information written on the medium.

8. A bowling alley management system comprising:

the automatic bowling scoring apparatus as defined in claim 1, 2, 4 or 5;

a front manager provided at a front desk; and a premium selecting device including a display for, upon receiving the medium, displaying a plurality of premiums corresponding to information written on the medium, wherein the front manager includes a displaying device for receiving and displaying the premium identification information.

9. An automatic bowling scoring apparatus comprising:

a pin-state detector for detecting a pin state after a bowl of a ball in a lane;

a score counter for counting a score of a bowling game based on a detection result by the pin-state detector;

a displaying device for displaying the score of the score counter; and a reckoning device for reckoning a charge for bowling games in response to a game count, the reckoning device including:

a medium to which information has been written, and a calculating device for calculating a bowling-game charge corresponding to value of the medium or information written on the medium accepted by the accepting device.

10. A bowling alley management system comprising:

a reception device for executing assignment of a lane from among empty lanes or managing a waiting order upon an operation by an incoming bowler or clerk in charge at a reception;

a console provided for a lane or for a plurality of lanes and including a device for counting a score of a bowling game by detecting a passage of a ball and a pin state in a lane; and an accepting device for accepting a medium to which information has been written, wherein the reception device includes a controller which starts the lane assignment or waiting-order management when the accepting device has accepted the medium.

11. An automatic bowling scoring apparatus comprising:

a score counter for determining a score of a bowling game by detecting a passage of a ball and a pin state in a lane;

an accepting device for accepting a medium to which information has been written; and a controller for executing score counting by the score counter with respect to number of games or number of frames corresponding to value of the medium or information written to the medium accepted by the accepting device.

* * * * *